US011235371B2

(12) United States Patent
Petit et al.

(10) Patent No.: US 11,235,371 B2
(45) Date of Patent: Feb. 1, 2022

(54) CLINCHING MACHINE

(71) Applicant: BTM Company, LLC, Marysville, MI (US)

(72) Inventors: Brian D. Petit, Algonac, MI (US); Andrew T. Sanders, Marysville, MI (US); Ryan T. Jones, Port Huron, MI (US)

(73) Assignee: BTM Company, LLC, Marysville, MI (US)

( * ) Notice: Subject to any disclaimer, the term of this patent is extended or adjusted under 35 U.S.C. 154(b) by 66 days.

(21) Appl. No.: 16/579,915

(22) Filed: Sep. 24, 2019

(65) Prior Publication Data

US 2020/0114412 A1 Apr. 16, 2020

Related U.S. Application Data

(60) Provisional application No. 62/745,767, filed on Oct. 15, 2018.

(51) Int. Cl.
*B21D 39/03* (2006.01)

(52) U.S. Cl.
CPC ..... *B21D 39/031* (2013.01)

(58) Field of Classification Search
CPC ..... B21D 39/031; B21D 39/035; B21J 9/12
See application file for complete search history.

(56) References Cited

U.S. PATENT DOCUMENTS

| | | | |
|---|---|---|---|
| 2,313,843 | A | 3/1943 | Shaff et al. |
| 3,123,912 | A | 3/1964 | Gury, III |
| 3,914,845 | A | 10/1975 | Olsson |
| 4,403,409 | A | 9/1983 | Richards |
| 4,878,284 | A | 11/1989 | Sawdon |
| 5,095,618 | A | 3/1992 | Pacey, Jr. |

(Continued)

FOREIGN PATENT DOCUMENTS

| | | | |
|---|---|---|---|
| EP | 1854566 | A1 | 11/2007 |
| EP | 2452761 | A2 | 5/2012 |
| WO | WO-2004/045787 | A1 | 6/2004 |

OTHER PUBLICATIONS

Photographs of Bollhoff Attexor Rivclinch Machine, offered for sale prior to Oct. 2018, 15 pages.

(Continued)

*Primary Examiner* — Jacob J Cigna
(74) *Attorney, Agent, or Firm* — Harness, Dickey & Pierce PLC

(57) ABSTRACT

A clinching machine and method for using a clinching machine are provided. In another aspect, a hand-held clinching machine and method employ a movable jaw, a cam wedge, and a rocker arm to control opening and closing movement of the clinching jaw. Another aspect of a clinching machine and method includes a movable clinching jaw, a fluid activated piston, a manually actuated switch which causes fluid actuated rotation of a lever, a manually actuated trigger to fluidically advance a piston and a block attached to a forward end of a piston rod, and an abutting stop surface movable with the movable jaw, where the stop surface abuts against the lever in an operating condition to limit opening rotation of the movable jaw to an intermediate position between a fully open position and a fully closed and clinching position.

25 Claims, 36 Drawing Sheets

(56) References Cited

U.S. PATENT DOCUMENTS

| | | | | |
|---|---|---|---|---|
| 5,138,758 | A | 8/1992 | Gubbiotti et al. | |
| 5,208,974 | A | 5/1993 | Sawdon et al. | |
| 5,431,089 | A | 7/1995 | Sawdon | |
| 5,630,277 | A | 5/1997 | Kimura | |
| 5,642,559 | A | 7/1997 | Sawdon | |
| 5,727,302 | A | 3/1998 | Sawdon | |
| 5,806,362 | A | 9/1998 | Dubugnon | |
| 5,937,694 | A | 8/1999 | Mueller | |
| 10,456,824 | B2 * | 10/2019 | Janiszewski | B21J 15/28 |
| 10,512,964 | B2 * | 12/2019 | Lutolf | B25B 27/026 |
| 2018/0161844 | A1 * | 6/2018 | Lutolf | B25B 27/026 |
| 2019/0084136 | A1 * | 3/2019 | Kundracik | B25B 27/146 |

OTHER PUBLICATIONS

BTM's Tog-L-Loc and Lance-N-Loc Patented Sheet Metal Joining Systems—User's Guide for Tooling, published prior to Oct. 12, 2018, 20 pages.

Hand-Held Clinching Units, www.btmcorp.com/clinching-equipment.html, Catalog ID# 735451, published prior to Oct. 12, 2018, 36 pages.

RIVCLINCH® 0404 IP—User Manual, Bollhoff Attexor SA, Sep. 2, 2014, 42 pages.

RIVCLINCH 0404 IP V3 A C MST—Spare parts list, Bollhoff Attexor, 2016, 18 pages.

* cited by examiner

CLINCHING MACHINE

CROSS-REFERENCE TO RELATED APPLICATIONS

This application claims the benefit of U.S. Provisional Application No. 62/745,767, filed on Oct. 15, 2018. The entire disclosure of the above application is incorporated by reference herein.

BACKGROUND AND SUMMARY

The present disclosure relates generally to clinching machines and more particularly to a hand-held clinching machine.

It is known to use a clinching machine having a punch and an opposed die for creating a clinch joint between sheet metal workpieces. Most conventional clinching machines are stationarily mounted to a factory floor or fixture, but their full clinching cycle is too slow for creating multiple adjacent clinch joints quickly with a single tool.

Some traditional hand-held clinching tools have been used. Hand-held examples are disclosed in: U.S. Pat. No. 4,878,284 entitled "Hand Held Sheet Metal Joining System" which issued to Sawdon on Nov. 7, 1989; U.S. Pat. No. 5,642,559 entitled "Portable Sheet Material Joining Tool" which issued to Sawdon on Jul. 1, 1997; and U.S. Pat. No. 5,806,362 entitled "Method and Apparatus for Carrying Out An Operation on a Mechanical Workpiece" which issued to Dubugnon on Sep. 15, 1998; which are all incorporated by reference herein. The commercial version of the Dubugnon hand-held clinching tool has employed a U-shaped, small and multi-piece handle which is very uncomfortable for a user to hold, since it is difficult if not impossible to fit the entire user's hand therein. Furthermore, the commercial version of the Dubugnon hand-held units have difficult to activate manual switches as well as other mechanical protuberances which are prone to snagging on workpieces and make it difficult to access desired joint locations for workpieces with multiple offset surfaces.

In accordance with the present invention, a clinching machine and method for using a clinching machine are provided. In another aspect, a hand-held clinching machine and method employ a movable jaw, a cam wedge, and a rocker arm to control opening and closing movement of the clinching jaw. Another aspect of a clinching machine and method includes a movable clinching jaw, a fluid activated piston, a manually actuated switch which causes fluid actuated rotation of a lever, a manually actuated trigger to fluidically advance a piston and a block attached to a forward end of a piston rod, and an abutting stop surface movable with the movable jaw, where the stop surface abuts against the lever in an operating condition to limit opening rotation of the movable jaw to an intermediate position between a fully open position and a fully closed and clinching position.

The present clinching machine and method are advantageous over conventional devices. For example, the present clinching machine and method provide a more cost effective and smaller package wherein a movable clinching jaw is limited to an intermediate opening position in one operating condition. This intermediate position makes subsequent jaw closure much faster to apply multiple clinching joint formations in a very fast and repeatable manner. Furthermore, the present clinching machine and method are advantageously easier to adjust a fully open jaw position. The present clinching machine and method are more cost effective and contained within a smaller packaging space due to all actuating movement being either pneumatic fluid or spring activated, without electrical controls or sensors. Moreover, the single piece and polymeric handle aspect of the present clinching machine and method make user grasping much more comfortable and less prone to fatigue; thus, much more ergonomical. Additional advantages and features of the present invention will become apparent from the following description and appended claims, taken in conjunction with the accompanying drawings.

DETAILED DESCRIPTION

Figure 1:
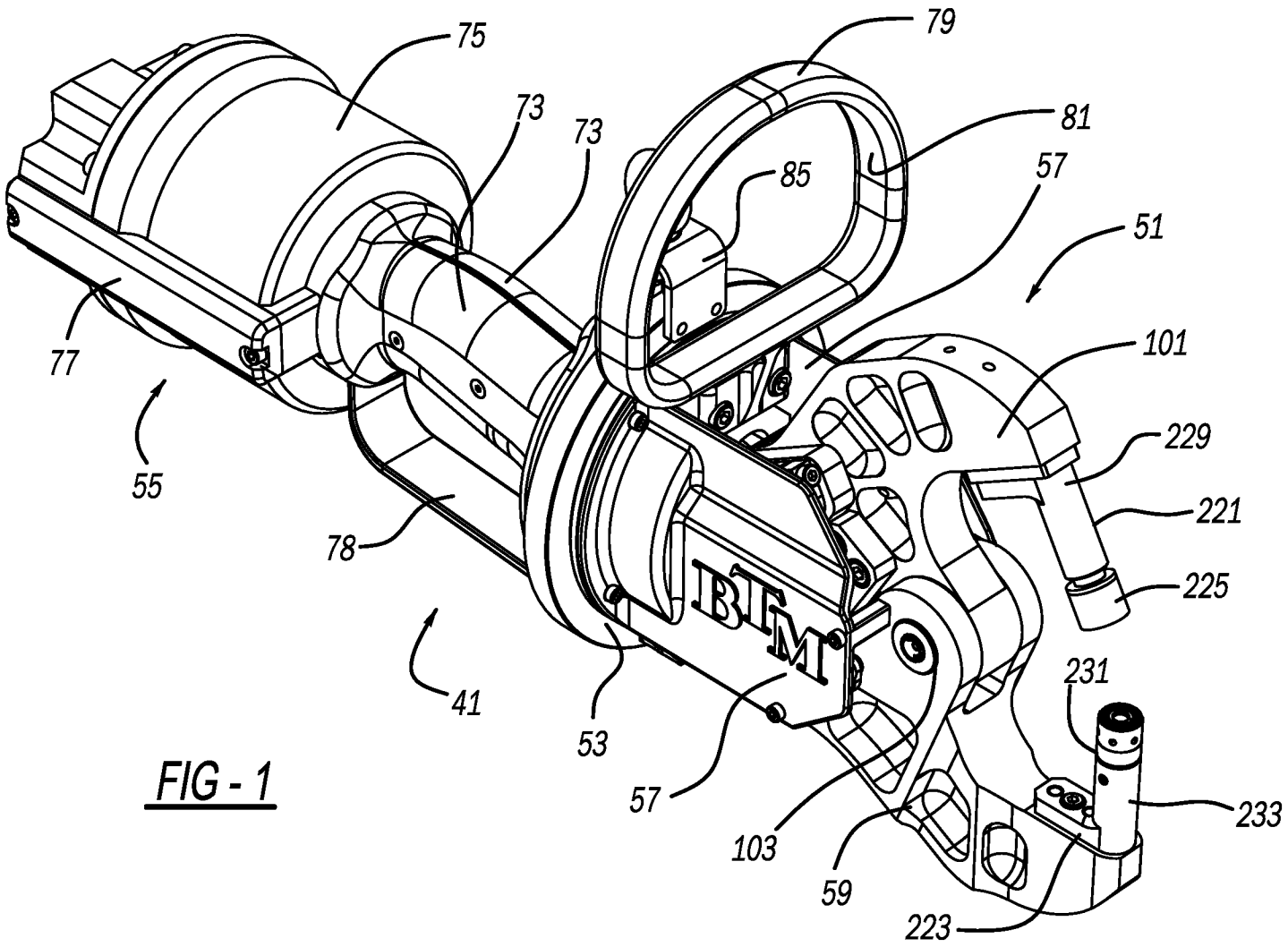
FIG. 1 is a front perspective view showing the present clinching machine.
Figure 2:
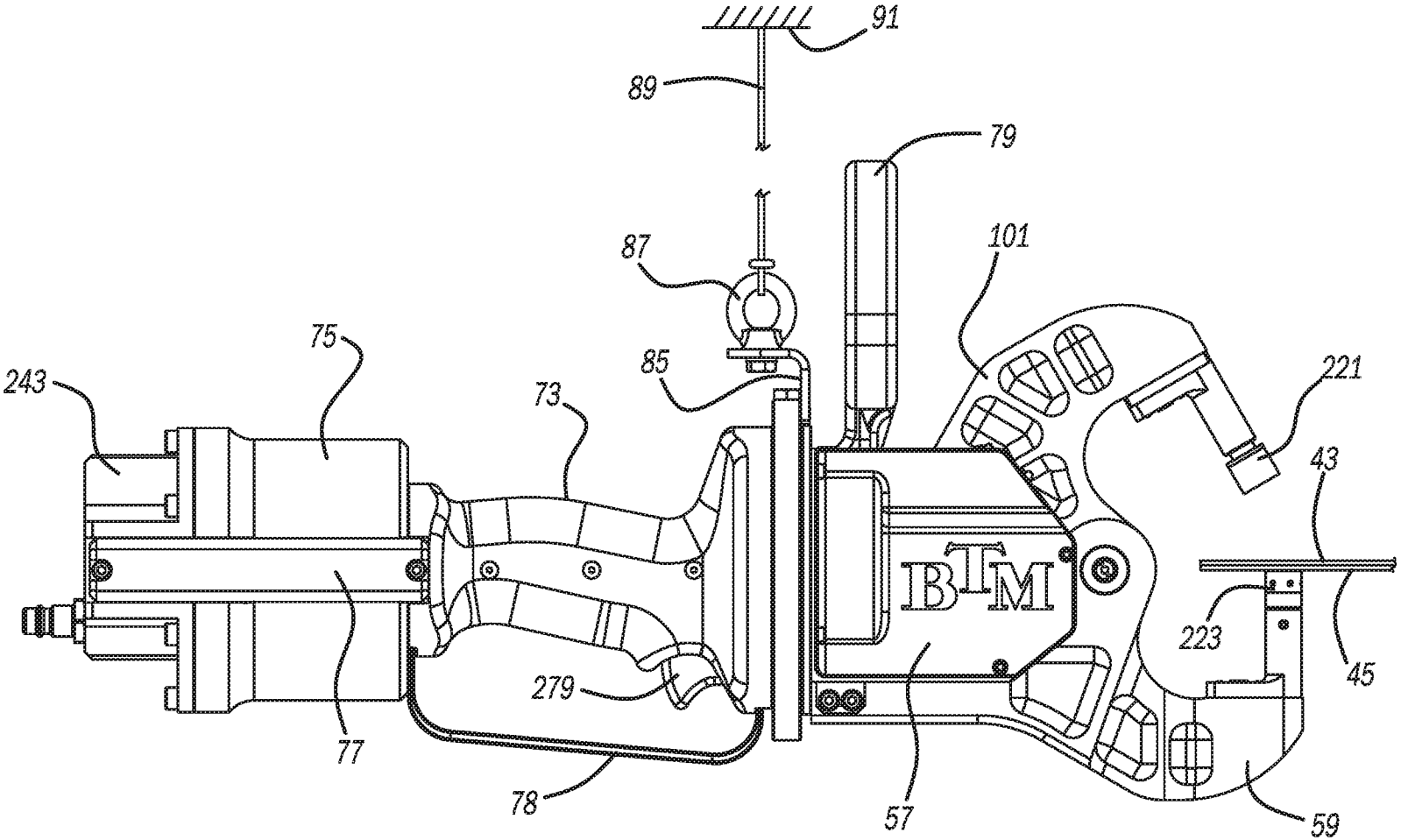
FIG. 2 is a side elevational view showing the present clinching machine.
Figure 3:
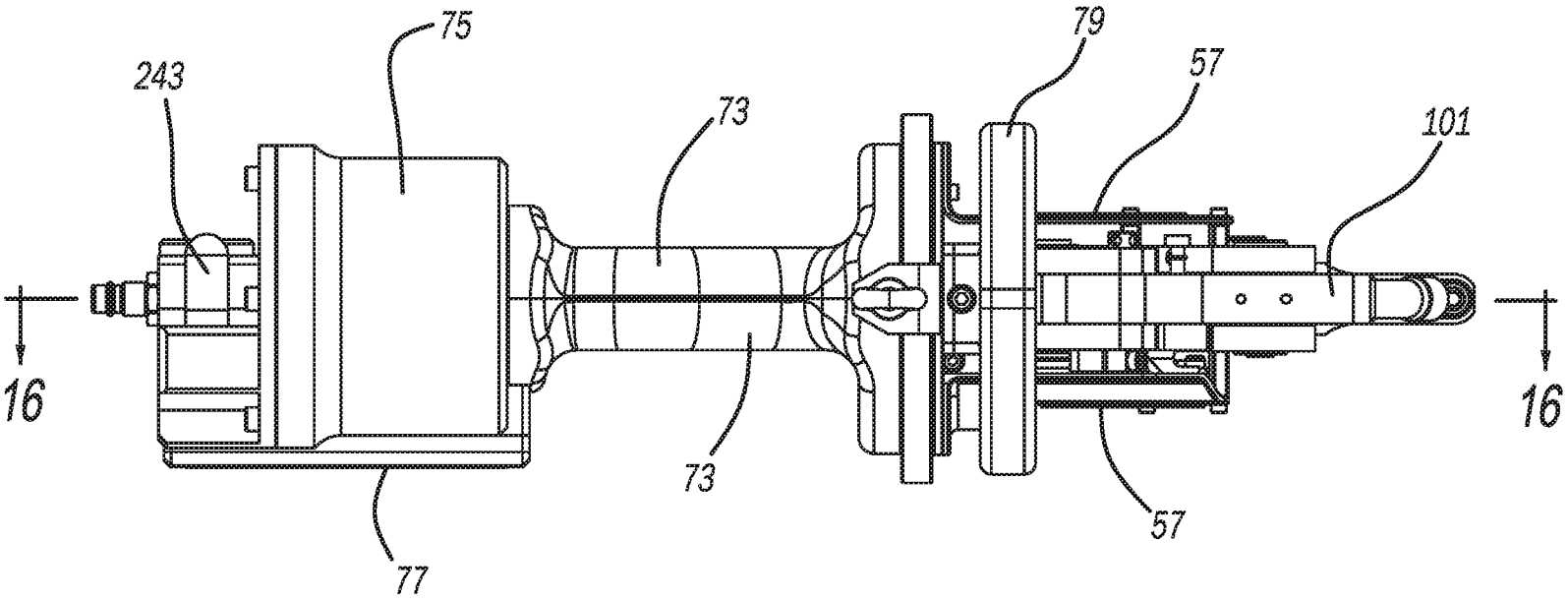
FIG. 3 is a top elevational view showing the present clinching machine.
Figure 4:
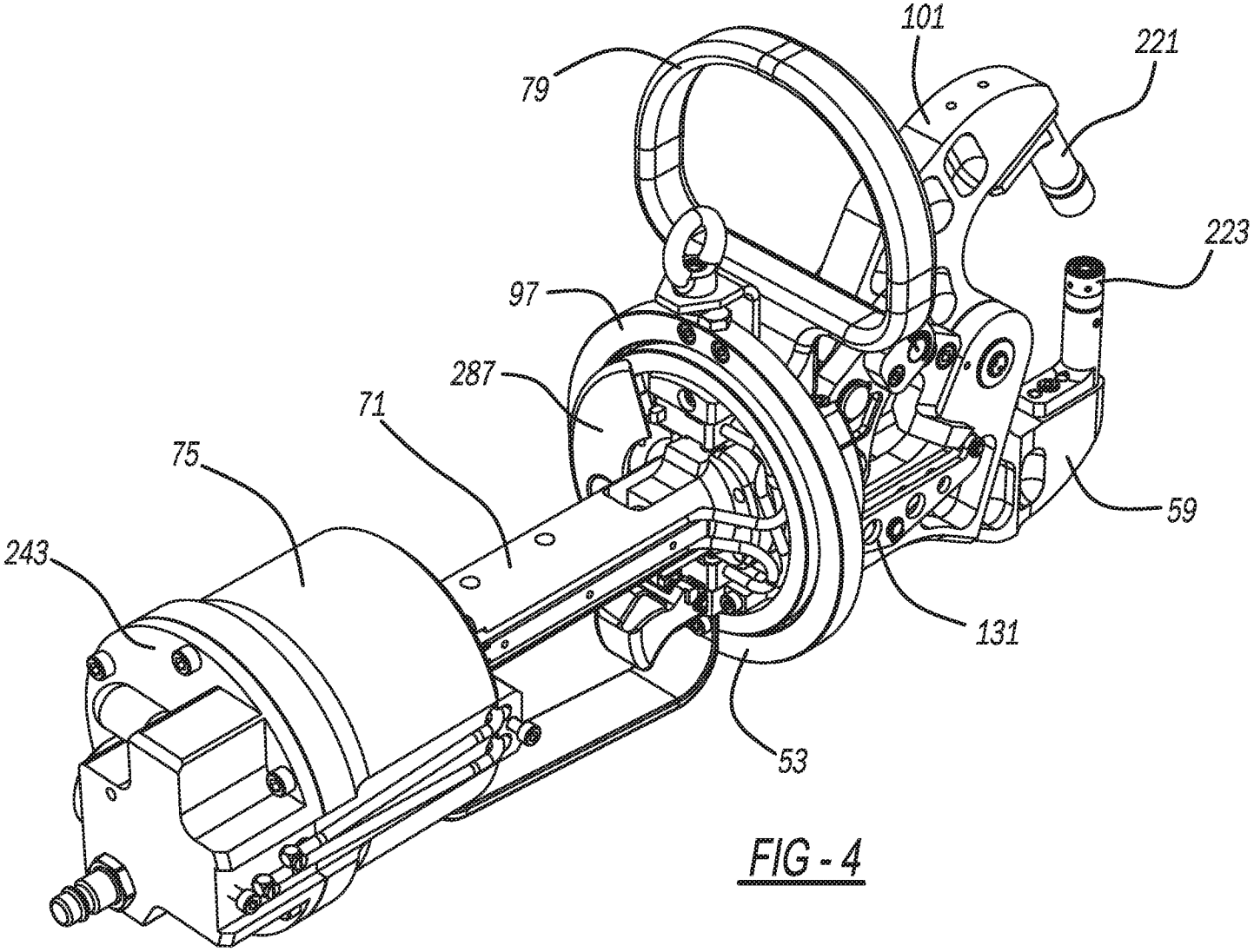
FIG. 4 is a rear perspective view showing the present clinching machine, with external housings removed.
Figure 5:
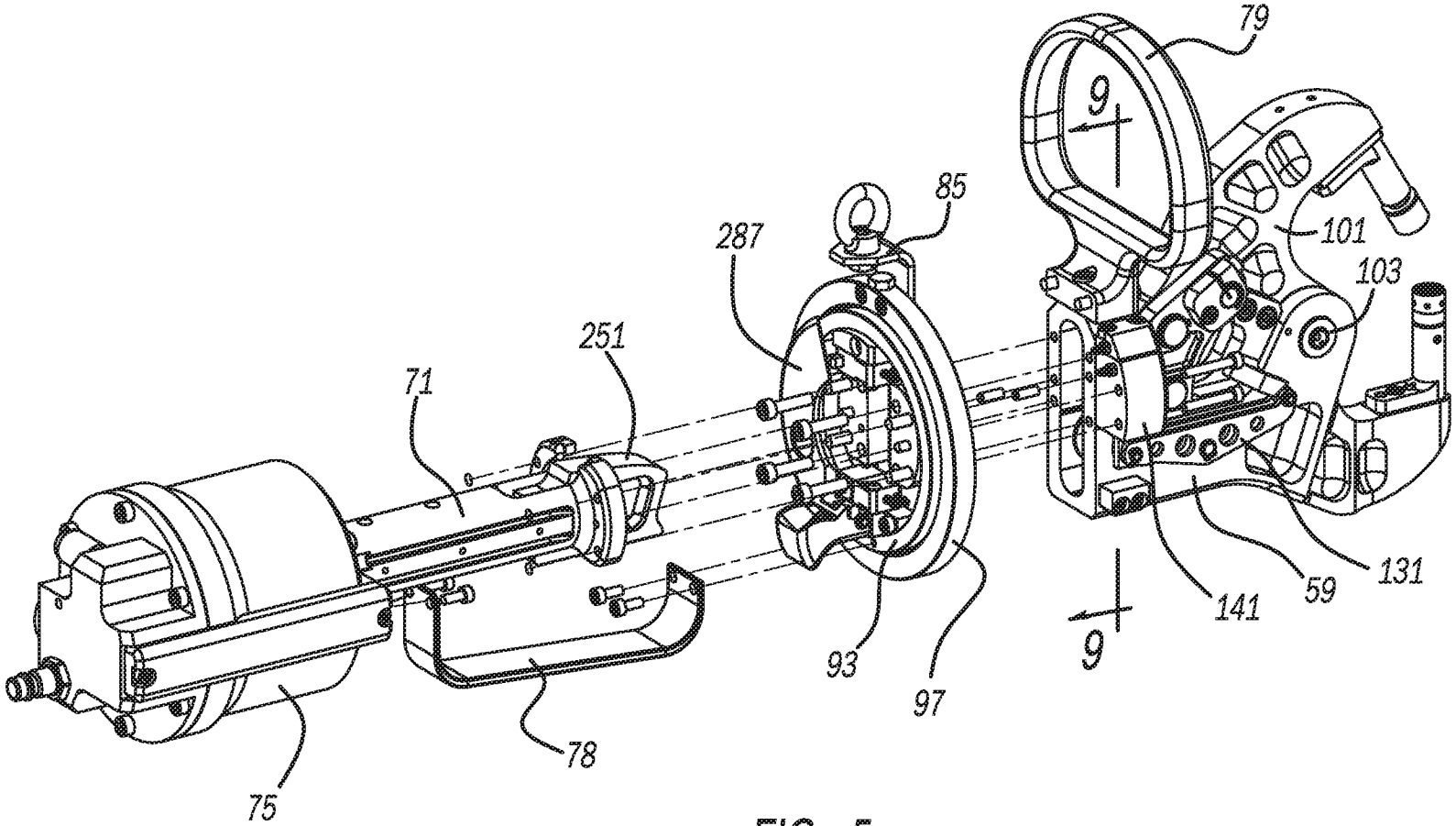
FIG. 5 is a partially exploded, rear perspective view showing the present clinching machine, with central and forward external housings removed.
Figure 6:
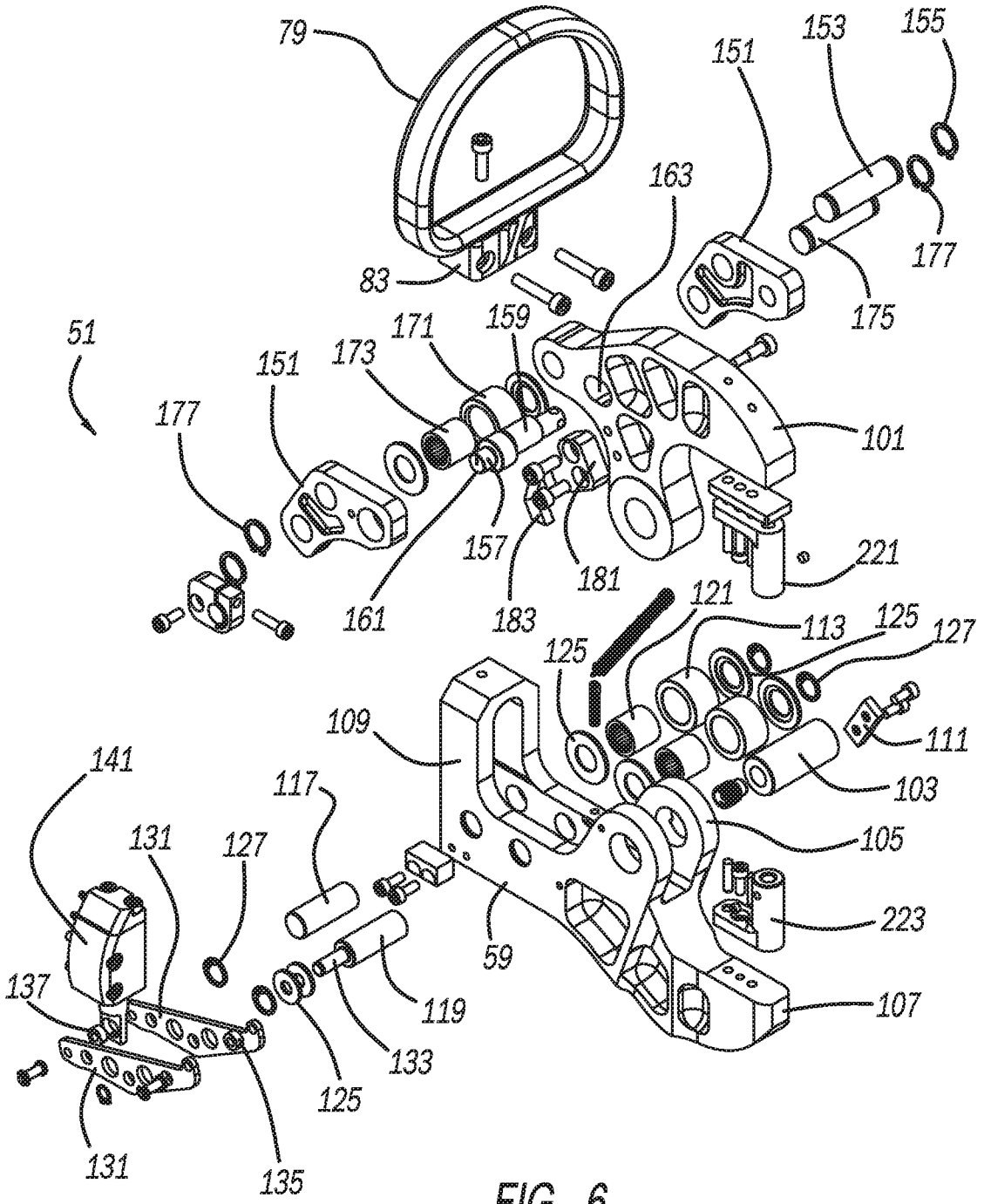
FIG. 6 is an exploded, front perspective view showing a jaw assembly of the present clinching machine.
Figure 7:
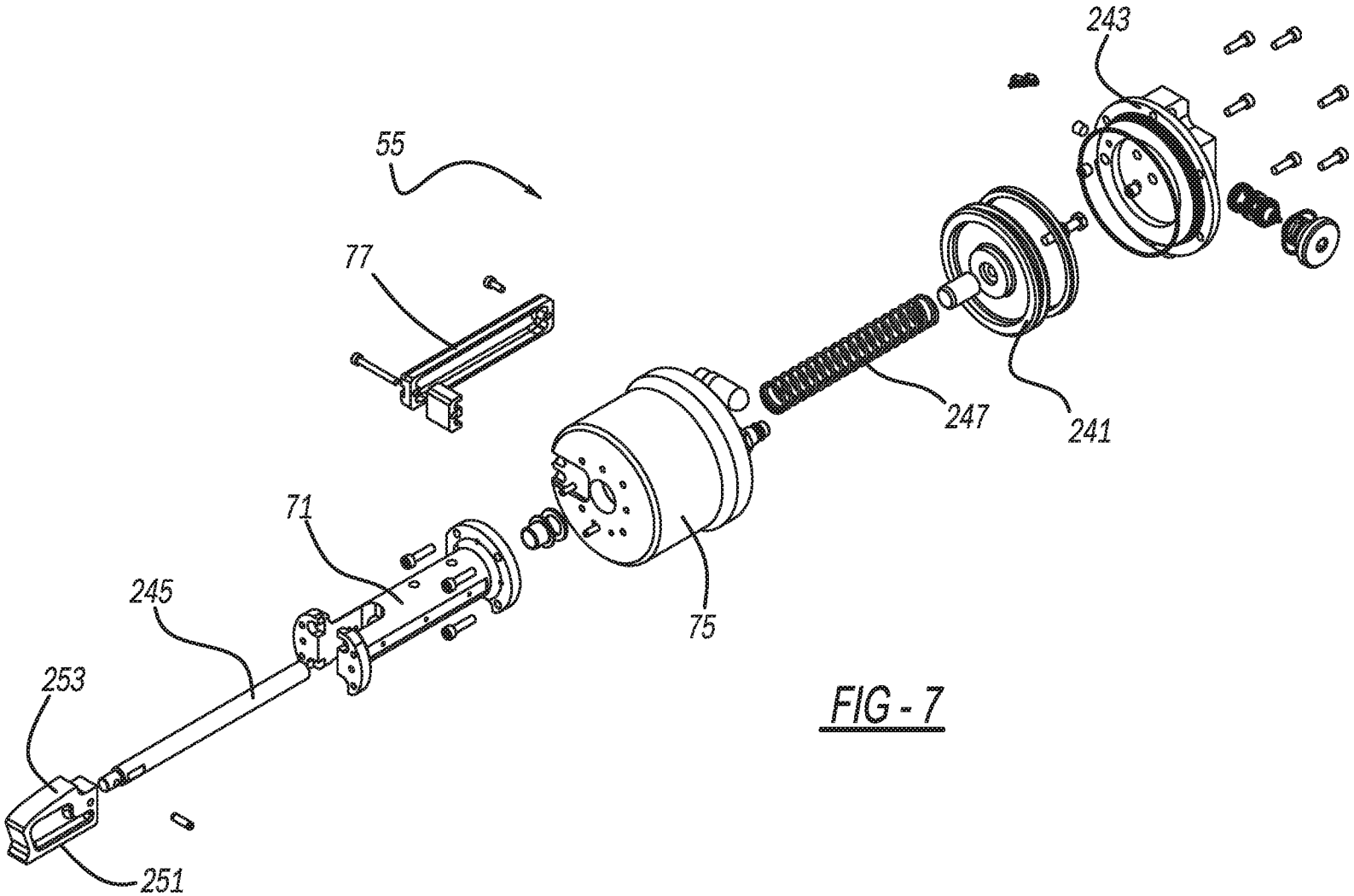
FIG. 7 is an exploded, front perspective view showing a piston assembly of the present clinching machine.
Figure 8:
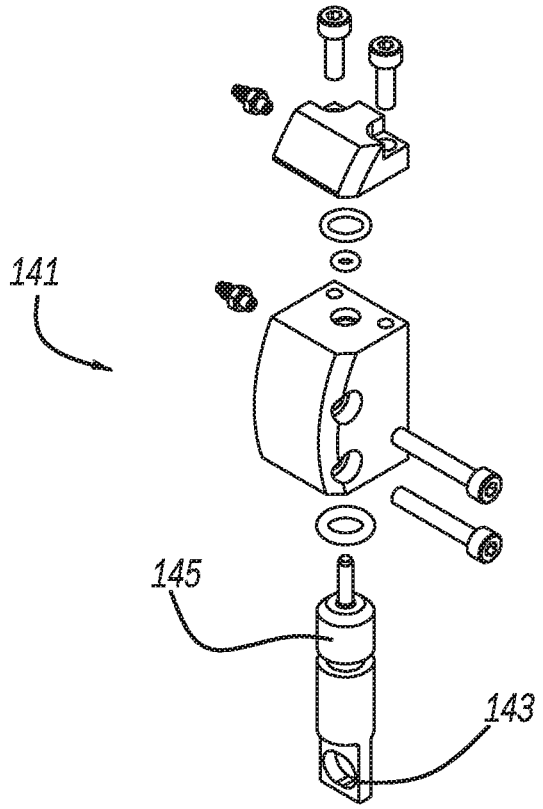
FIG. 8 is an exploded, front perspective view showing an intermediate work position cylinder assembly of the present clinching machine.
Figure 9:
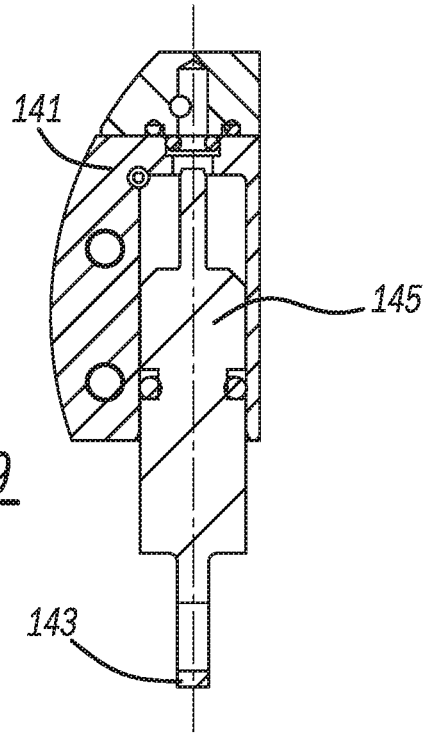
FIG. 9 is a cross-sectional view, taken along line 9-9 of FIG. 5, showing the intermediate work position cylinder assembly of the present clinching machine, in an advanced position.
Figure 10:
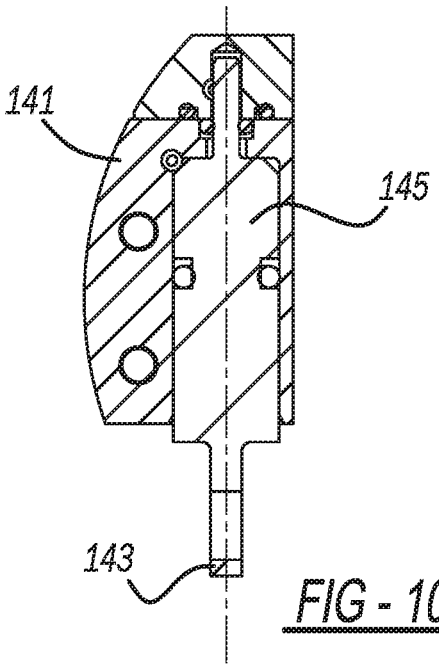
FIG. 10 is a cross-sectional view, taken along line 9-9 of FIG. 5, showing the intermediate work position cylinder assembly of the present clinching machine, in a retracted position.

FIGS. 1-5 illustrate a first exemplary embodiment of a clinching machine apparatus 41 used to create a clinch joint between multiple sheet metal workpieces 43 and 45. Clinching machine 41 includes a jaw assembly 51 at a forward end, a pivot ring assembly 53 and a piston assembly 55 at a rear end. A pair of polymeric exterior housings 57 sandwich a rear section of jaw assembly 51 and are removeably screwed onto ring assembly 53 and a stationary lower jaw 59 of the jaw assembly.

Piston assembly 55 includes a structural and central spine 71 to which a pair of polymeric central housings 73 are removeably screwed. Central housings 73 include an elongated middle section together creating a generally circular hollow area enclosing spine 71. Furthermore, laterally projecting leading and trailing sections of central housings 73 enclose the adjacent circular portions of ring assembly 53 and piston assembly 55, respectively. A person using or operating the clinching machine grasps one of his or her hands around central housing 73, which has a curved upper surface and a diagonally angled lower surface to comfortably conform to the user's palm and fingers. Moreover, spine 71 is longitudinally elongated with a forward end screwed to a back face of ring assembly 53, and with a rear end screwed to a front face of a hollow piston cylinder 75 of piston assembly 55. An elongated and L-shaped polymeric housing 77 is removably screwed to an exterior side of piston cylinder 75.

An enclosed polymeric trigger guard 78 is screwed onto ring assembly 53 and piston cylinder 75. Additionally, a generally D-shaped and entirely enclosed handle 79 is preferably made as a single piece polymeric member. An interior surface 81 defines a curved through-opening within which the user can entirely place his or her entire hand or fingers for handle gripping. A lateral dimension of the handle through-opening is at least 100 mm at its widest horizontal portion. Furthermore, a flange 83 downwardly projects from a central and generally flat bottom of handle 79, which is screwed to the front face of ring assembly 53.

Handle 79, guard 78 and all of housings 57, 73 and 77 are preferably additively manufactured by three-dimensional printing polymer layers in a computer controlled three-dimensional printing ("3DP") machine. An exemplary 3DP machine has a head, with multiple polymer-emitting nozzles, which slides along a moveable gantry above a machine table in an ambient air environment. Light sources within the 3DP machine emit light to cure each layer before the next is added. This 3DP manufacturing advantageously creates the curved handle without conventional injection molding parting lines otherwise uncomfortable to the user's hand, and for creating internal ribs and undercuts that would be die-locked or more expensive to manufacture with injection molding. Nevertheless, injection molding may alternately be employed although the noted 3DP advantages may not be achieved.

Figure 11:
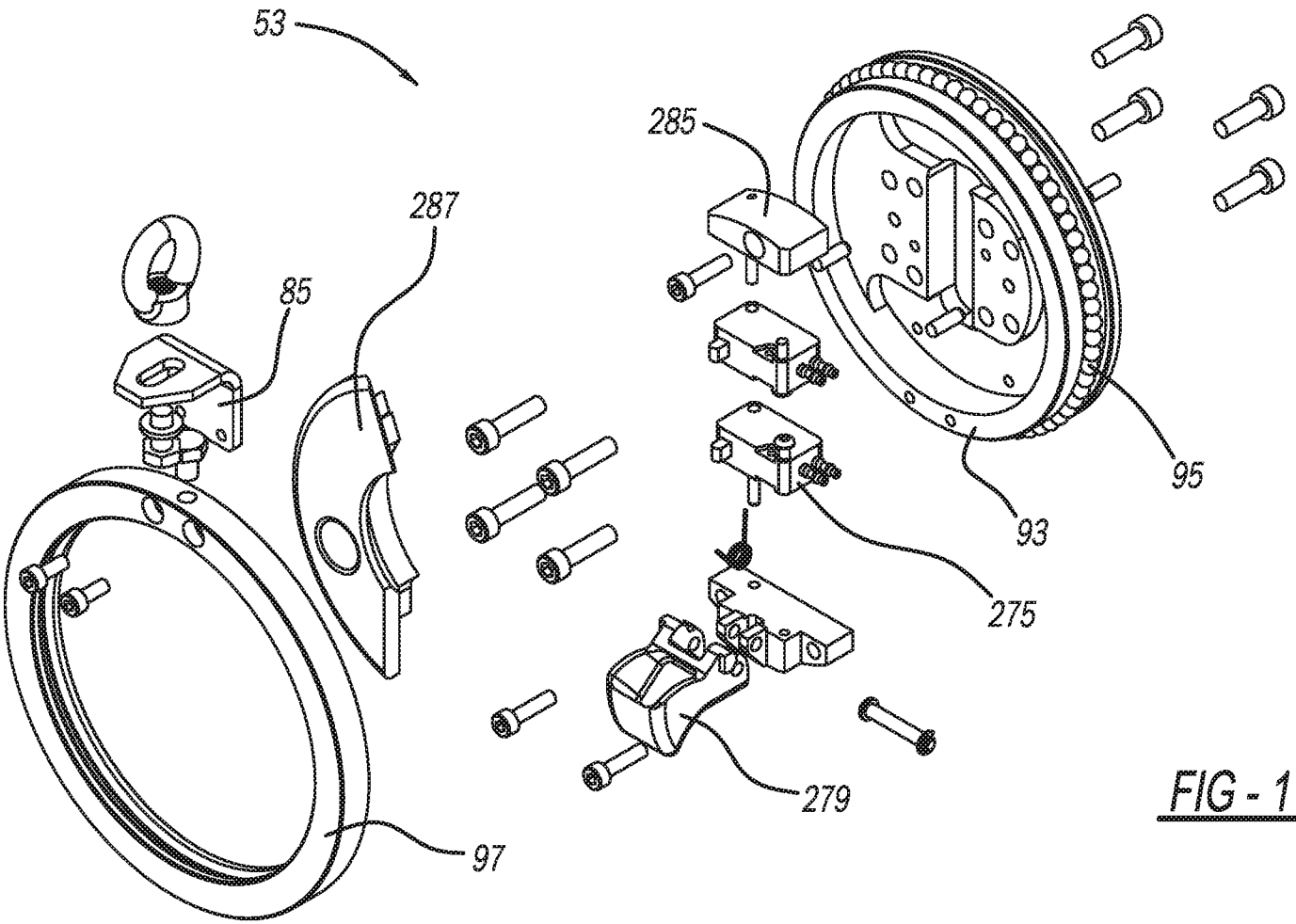
FIG. 11 is an exploded, rear perspective view showing a pivot ring assembly of the present clinching machine.

An L-shaped metallic tab 85 is screwed to an upper section of the front face of ring assembly 53. An eyelet 87 is mounted to tab 85 and a flexible cable 89 is hooked onto the eyelet. Cable 89 is hung from an underside of a factory ceiling or structural beam 91. Thus, portable and hand-held clinching machine 41 is suspended about its center of gravity, which is approximately at the intersection of spine 71 and ring assembly 53 for maximum balance. As can be observed in FIG. 11, ring assembly 53 includes an internal hub 93 around which is mounted a ball bearing race 95. The front and back mounting faces are part of or attached to hub 93. An outer ring 97 is rotatably mounted to hub 93 with ball bearing race 95 therebetween. Ring assembly 53 serves as both a gimble and a mounting structure. Therefore, handle 79 attached to hub 93, as well as the affixed jaw assembly and piston assembly, can together be rotated for ease of access to the workpieces, while outer ring 97 remains suspended from the factory ceiling.

Reference should now be made to FIGS. 6 and 12-16. Jaw assembly 51 includes stationary lower jaw 59 and a movable upper jaw 101. The jaws are coupled together by a pivot pin 103 which spans between a pair of bifurcated knuckles 105 upstanding between a front end 107 and a rear end 109 of lower jaw 59. Furthermore, rear end 109 has an inverted U-shape with a hollow passageway extending between knuckles 105. A rectangular key 111 has a lower end received and screwed within a pocket of lower arm 59. Moreover, an upper end of key 111 is received and screwed within a pocket of pivot pin 103, thereby preventing pivot pin 103 from rotating. A pair of cam followers 113 and 115, such as the illustrated rollers journalled about pins 117 and 119, with bearing races 121 therebetween, are span across the hollow passageway and are attached to the spaced apart side walls of lower jaw 59 by washers 125 and circlip fasteners 127.

A pair of spaced apart and symmetrical rocker arm levers 131 have a common central pivot about a reduced diameter pin 133 coaxially projected from an end of roller pivot pin 119. A forward end of rocker arms 131 has a bushing 135 spanning therebetween on a pin, and a rearward end of rocker arms 131 also has another bushing 137 spanning therebetween on a pin.

A work position pneumatic valve 141 includes a piston rod 143 having an aperture through which bushing 137 and the associated pin extend. Thus, movement of a piston 145 and the associated rod 143 of valve 141 downwardly push and rotate rocker arms 131 about pivot 133, when valve 141 is actuated. This can best be observed in FIGS. 6, 9, 10, 12 and 13.

Returning to FIGS. 6 and 12-18, a pair of spaced apart and symmetrical tails 151 are adjustably coupled to opposite sides of the rear section of movable upper jaw 101 via a pivot pin 153 and circlips 155 extending through a middle hole in each tail. A generally cylindrical adjustment shaft 157 includes an enlarged central segment having an offset lobe 159 extending off of a centerline axis of the shaft. Shaft 157 also has a head 161 with a screw-driver receiving groove or alternately a hexagonal formation. Lobe 159 is received within a through-slot 163 in upper jaw 101. Hence, manual rotation of head 161 causes the lobe 159 to slot 163 interaction to rotate tails 151 about pivot pin 153. This rotates tails 151 relative to upper jaw 101 to provide adjustment should an intermediate opening position need to be varied for different thickness workpieces or for different sized clinching tools.

Another cam follower roller 171 is journalled about a ball bearing race 173 and pin 175. Pin 175 is fastened between holes in a lower segment of tails 151 by circlips 177. Furthermore, an abutment foot 181 is screwed to a side of movable upper jaw 101 and includes a downwardly projecting offset stop 183 which abuts against front roller 135 of rocker arms 131 in an operating condition.

Clinching tools are mounted in an opposing and aligned manner to jaws 59 and 101. Referring to FIGS. 1, 6, 16, 17 and 19-21, the clinching tools include a punch assembly 221 and a die assembly 223. Punch assembly 221 further includes an elongated workpiece striking punch 225, a generally cylindrical and elastomeric stripper 227 and a punch holder 229. The punch assembly is preferably mounted adjacent the front end of movable jaw 101.

Die assembly 223 includes a die 231 and a die holder 233. Die further has a central anvil 235 surrounded by laterally movable die blades 237. A cylindrical and elastomeric band or a canted coiled spring 239 retain and bias die blades 237 toward anvil 235 within a cylindrical outer shield 241. Die holder 233 couples die assembly 223 to a front end of stationary jaw 59. Exemplary clinching tools are disclosed in commonly owned U.S. Pat. No. 5,208,974 entitled "Apparatus for Attaching a Fastener to Sheet Material" which issued to Sawdon et al. on May 11, 1993; and U.S. Pat. No. 5,727,302 entitled "Die and Punch for Forming a Joint and Method of Making the Die" which issued to Sawdon on Mar. 17, 1998; both of which are incorporated by reference herein.

Thus, when moveable jaw 101 is rotated to its closed and clinching position (shown in FIG. 16), punch 225 deforms a round button in the workpieces 43 and 45, between a lower distal end of the punch and an upper distal end of anvil 235. Concurrently, the workpieces outwardly rotate the upper ends of the die blades which extend above the anvil. This creates an interlocking and leakproof clinch joint between the workpieces.

FIGS. 7, 14, 18 and 25 illustrate piston assembly 55. A peripherally cylindrical piston 241 is longitudinally moveable within a chamber internal to hollow and cup shaped piston cylinder 75. An end cap 243 is screwed onto a rear open section of piston cylinder 75, and inlet and exhaust pneumatic ports are located therein. A longitudinally elongated piston rod 245 is attached to a center of piston 241. Moreover, a helically coiled compression spring 247 surrounds a majority length of piston rod 245 and extends through an orifice in piston cylinder 75. A front end of spring 247 is located within a cavity abuts against an internal surface at a front half of spine 71 and a rear end of spring 247 abuts against a face of piston 241. A camming wedge block 251 is pinned to a distal end of piston rod 245 and has a camming surface 253 on a peripheral upper surface thereof. Camming surface 253 is preferably a constantly varying volute curve which is steeper on a leading section and flatter on a trailing section. Wedge block 251 further has a forked or multi-angled peripheral front surface and the wedge block has a longitudinal length at least five times greater than a lateral width. Also, a peripheral bottom surface of wedge block 251 is essentially flat.

Reference should now be made to FIGS. 12, 13, 17 and 22-28 for a pneumatic circuit employed in the clinching machine. Ends of an air actuation inlet tube 271 and an air actuation outlet tube 273 are in communication with ports of end cap 243. An opposite end of inlet tube 271 is in communication with a pneumatic power cycle switch 275. Switch 275 is mounted to ring assembly 53 beneath spine 71. A finger 277 of switch 275 is depressible by manual upward rotation of a trigger button 279 located on an opposite side of spine 71 from handle 79. Air is received from switch 275 to end cap 243 in an operating condition.

A front end of outlet tube 273 is in communication with intermediate work valve 141. Outlet tube 273 supplies pressurized air to valve 141 in an operating condition. Furthermore, a median tube 281 is a pneumatic connection between switch 275 and valve 141, whereby air flows from the valve to the switch in an operating condition. Moreover, another median tube 283 supplies air from an intermediate work position switch 285 to valve 141 when switch 285 is activated by the user manually rotating a button 287 relative to ring assembly 53. Button 287 is rearwardly facing and easily accessible through an opening in the central housing for thumb movement by the user's right hand when the right hand is grasping around the central housing and an index finger of the user's right hand may simultaneously depress the trigger.

The tubes are made from a flexible and polymeric material. Tubes 271 and 273 are routed in one or more channels along an outside of the end cap, piston cylinder and spine. This recessed routing prevents the tubes from being pinched when the rear and central housings 77 and 73, respectively, are installed.

Figure 12:
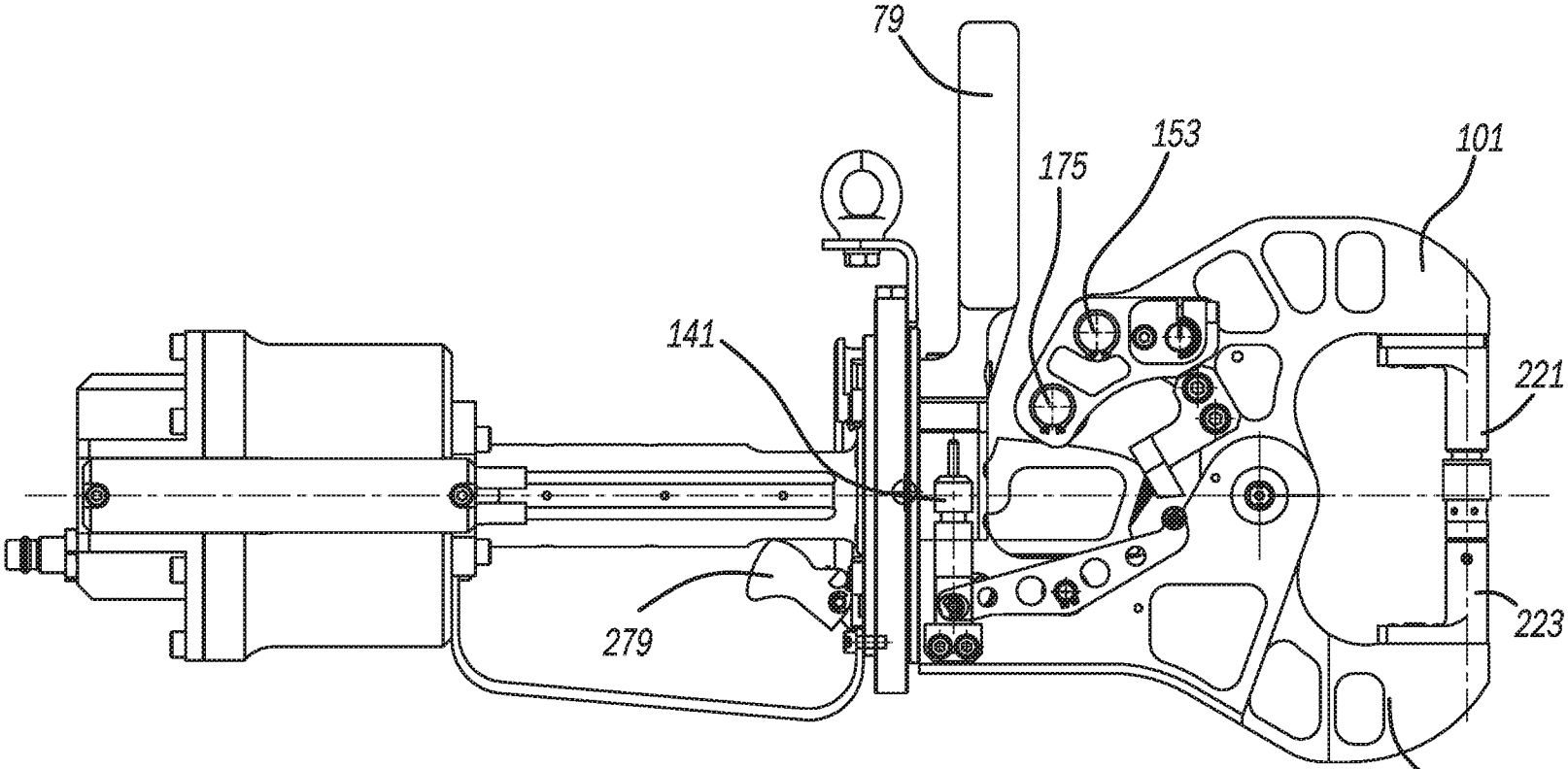
FIG. 12 is a side elevational view showing the present clinching machine, with the central and forward housings removed, and with jaws in a closed and workpiece clinching position.
Figure 13:
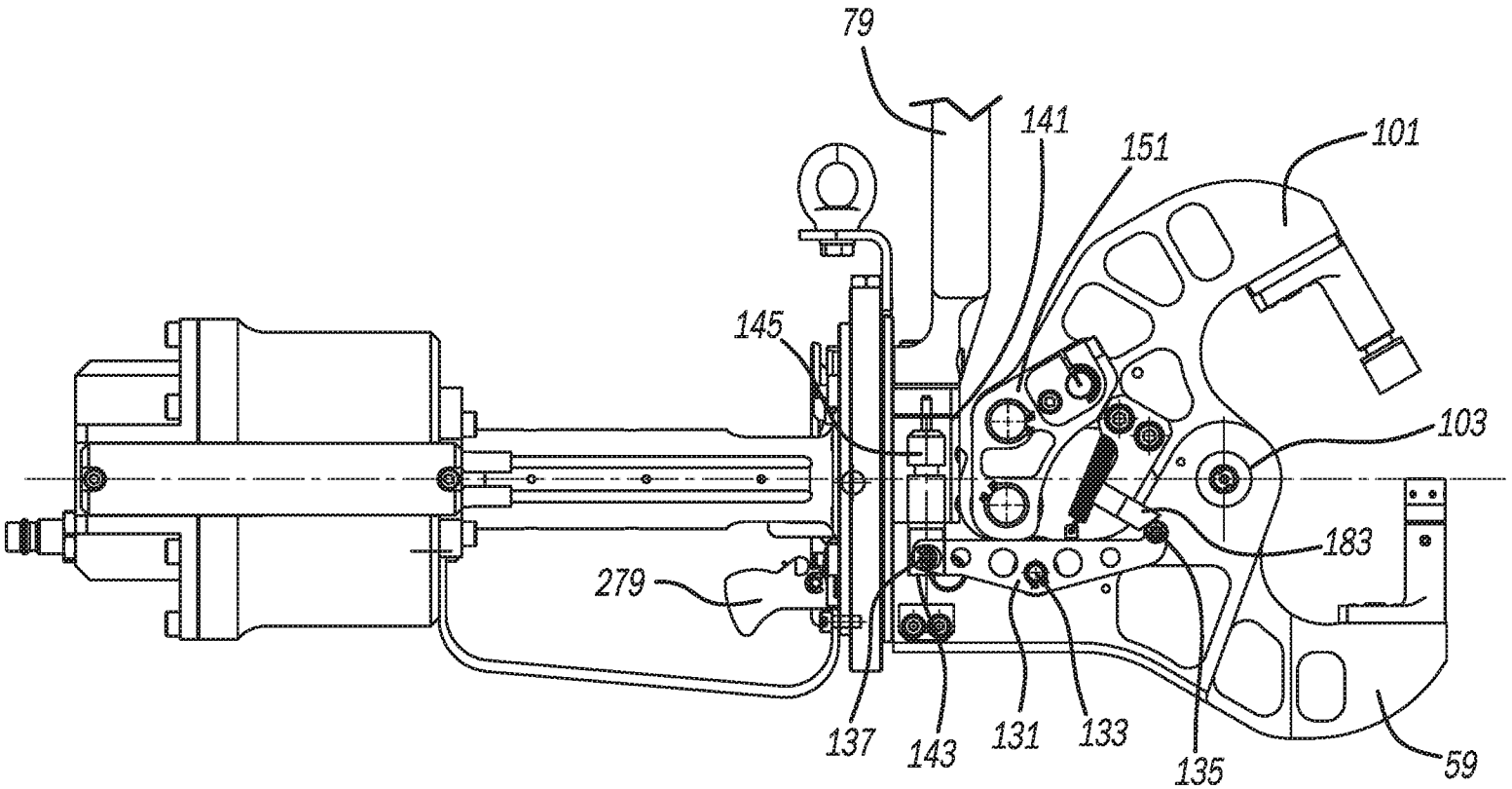
FIG. 13 is a side elevational view showing the present clinching machine, with the central and forward housings removed, and with the jaws in a fully open position.
Figure 14:
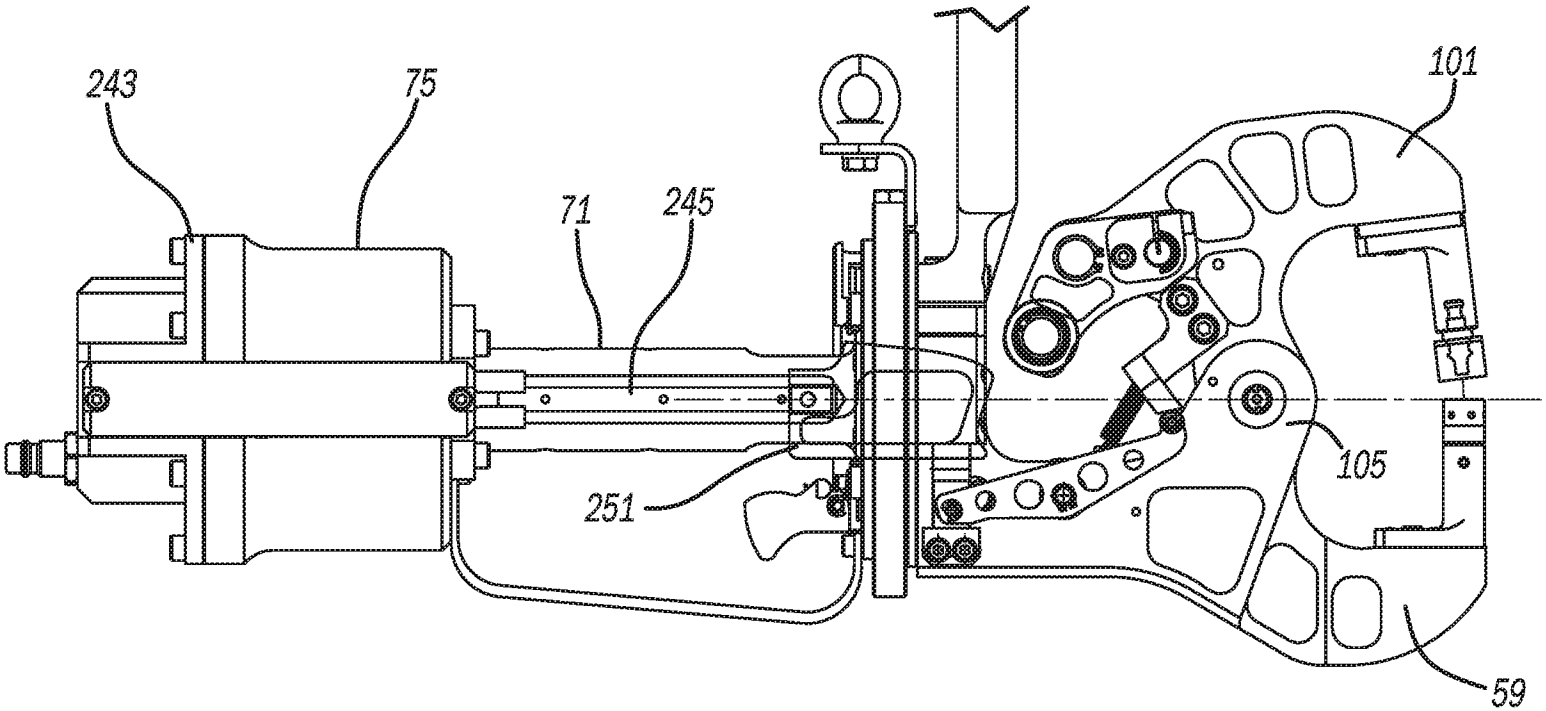
FIG. 14 is a side elevational view showing the present clinching machine, with the central and forward housings removed, and with the jaws in an intermediate open position.
Figure 15:
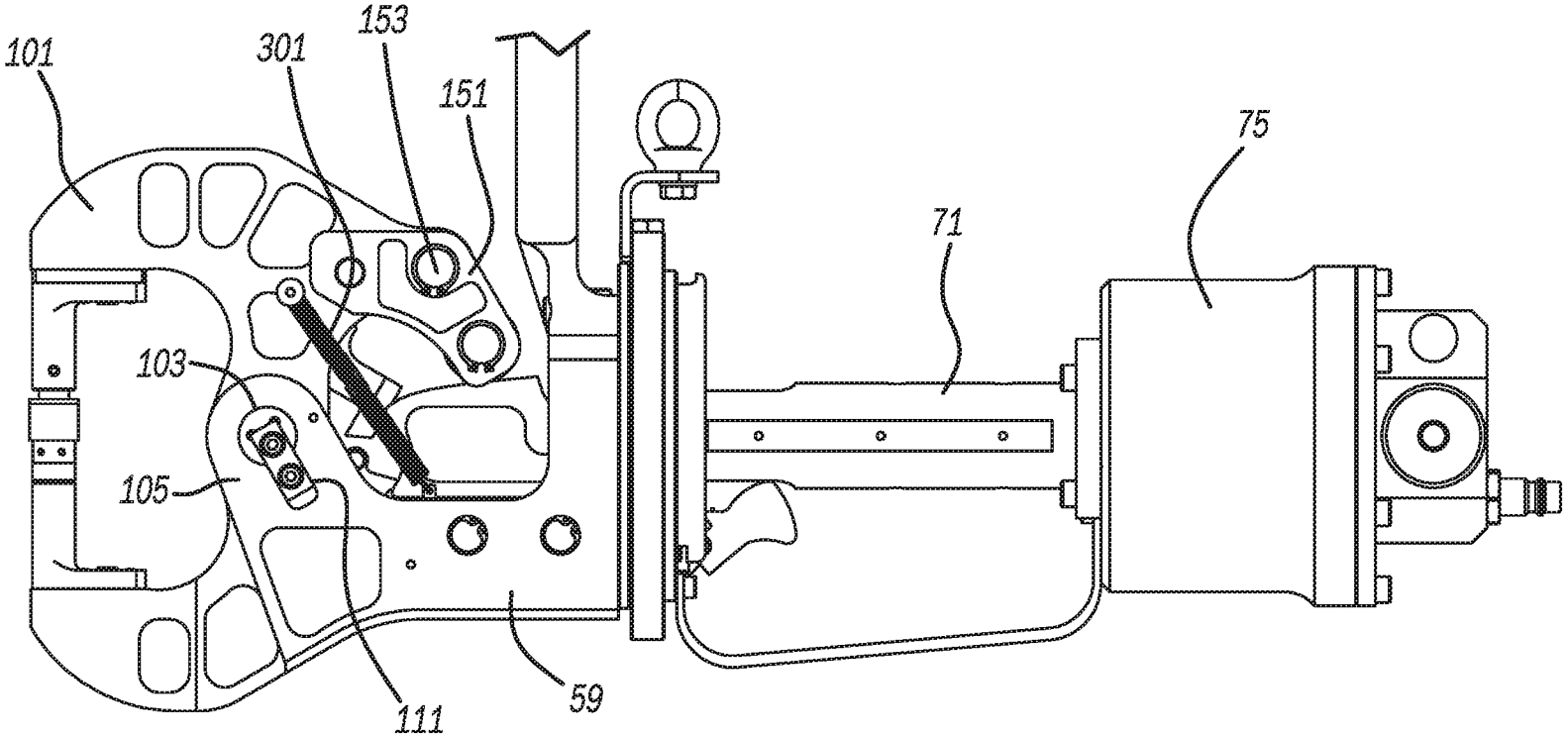
FIG. 15 is a side elevational view, opposite that of FIG. 12, showing the present clinching machine in the jaw closed position.
Figure 16:
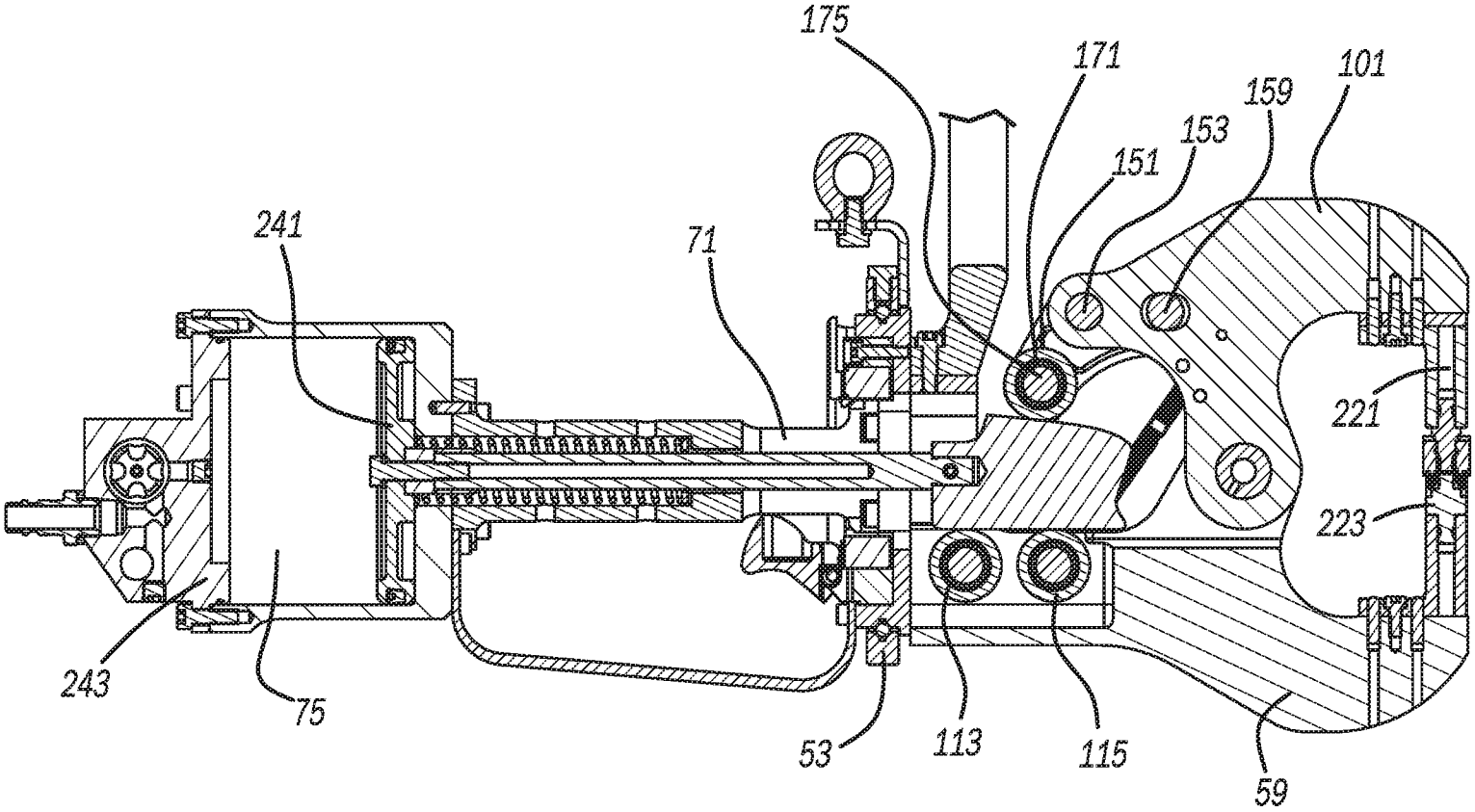
FIG. 16 is a cross-sectional view, taken along line 16-16 of FIG. 3, showing the present clinching machine, with the jaws in the closed position.
Figure 17:
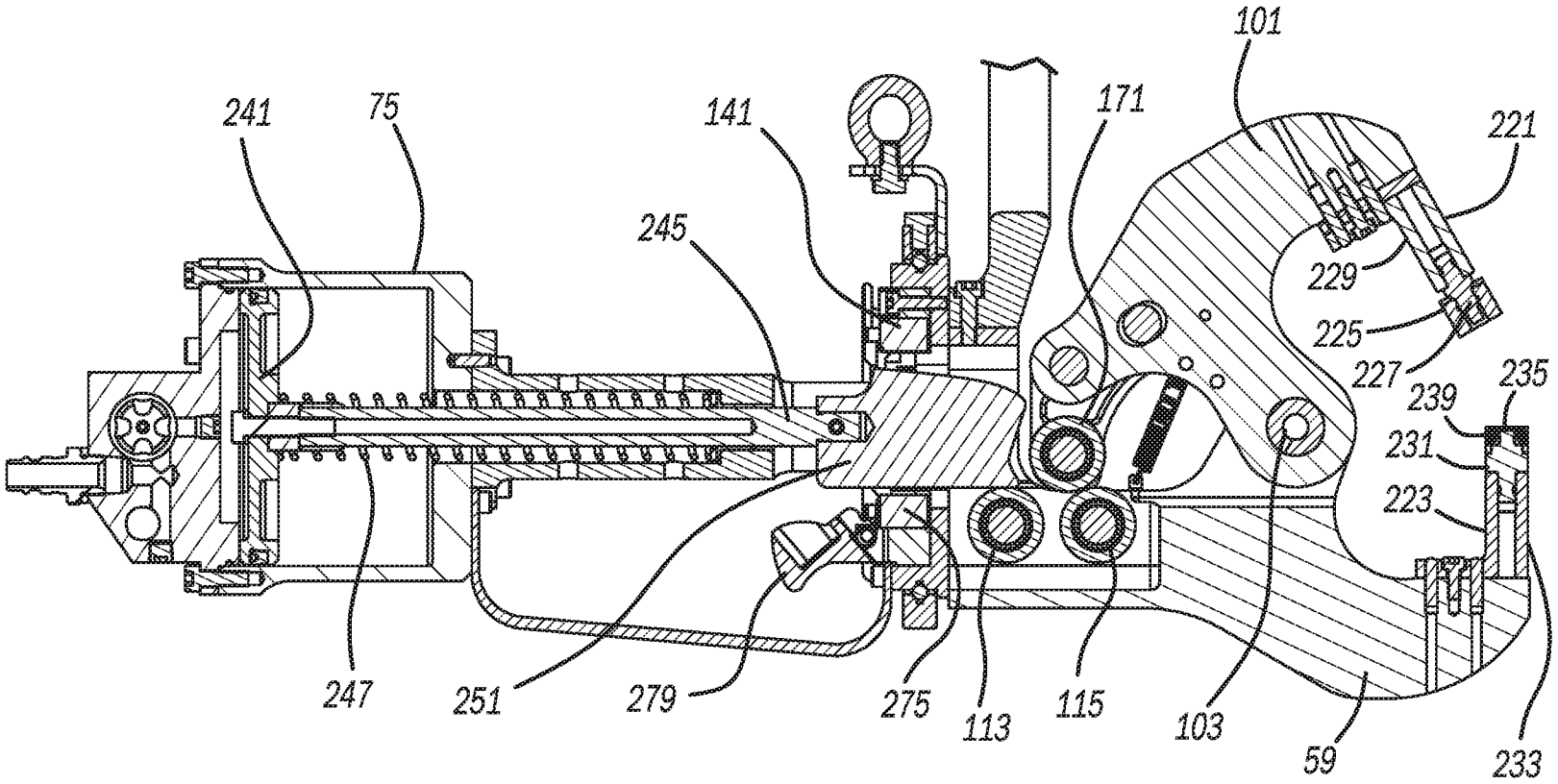
FIG. 17 is a cross-sectional view, taken along line 16-16 of FIG. 3, showing the present clinching machine, with the jaws in the fully open position.
Figure 18:
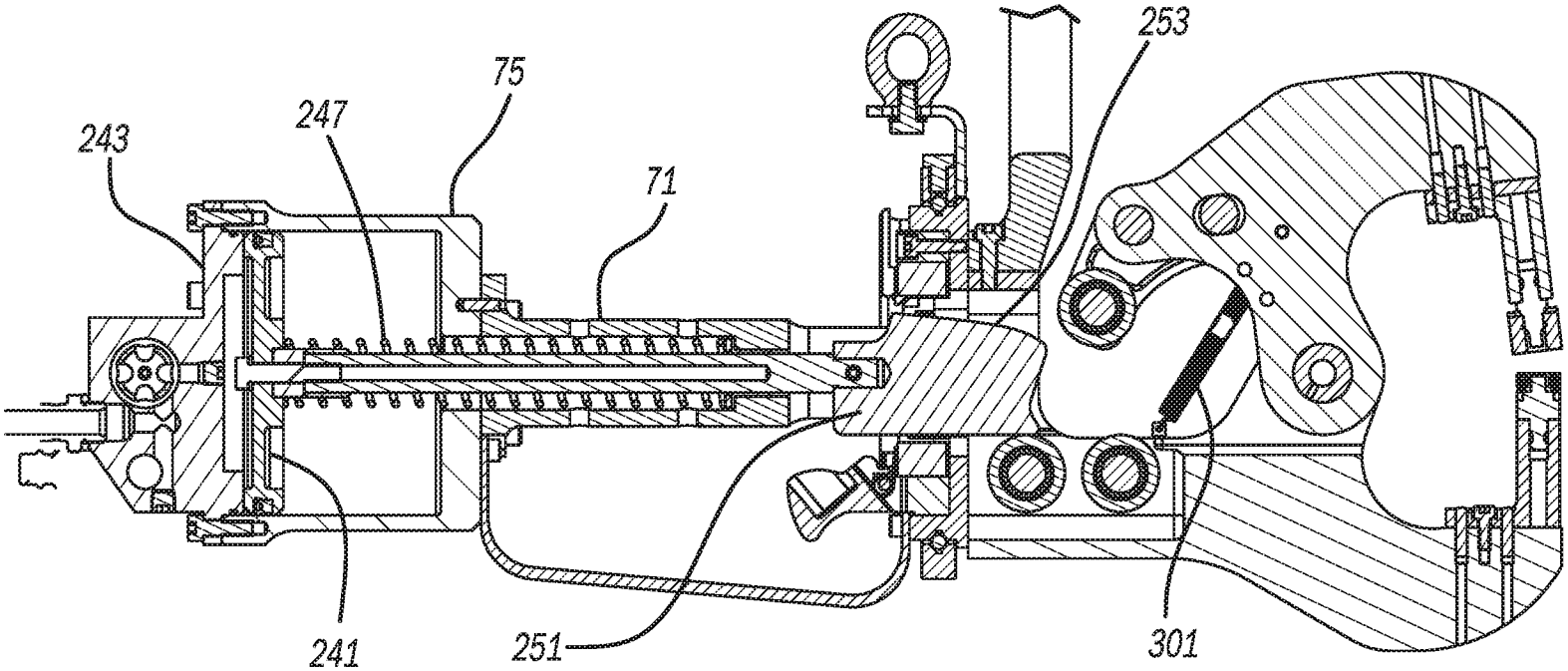
FIG. 18 is a cross-sectional view, taken along line 16-16 of FIG. 3, showing the present clinching machine, with the jaws in the intermediate open position.
Figure 19:
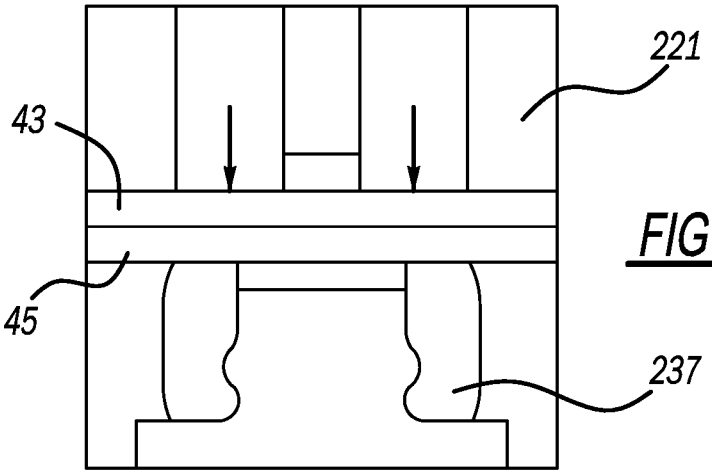
FIG. 19 is a diagrammatic cross-sectional view showing clinching tools of the present clinching machine, in an initial workpiece contacting condition.
Figure 20:
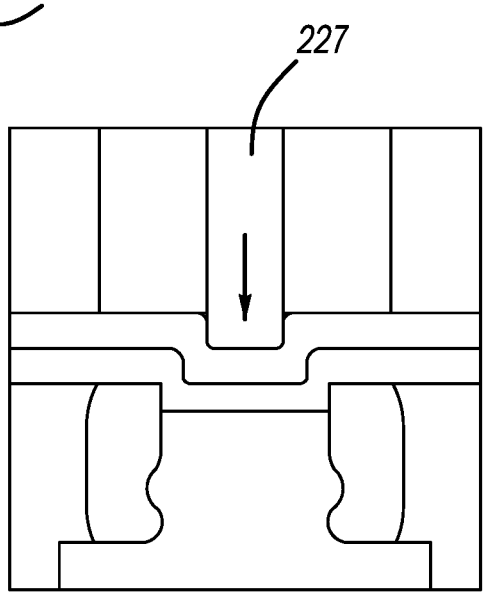
FIG. 20 is a diagrammatic cross-sectional view showing the clinching tools of the present clinching machine, in a mid-workpiece clinching condition.
Figure 21:
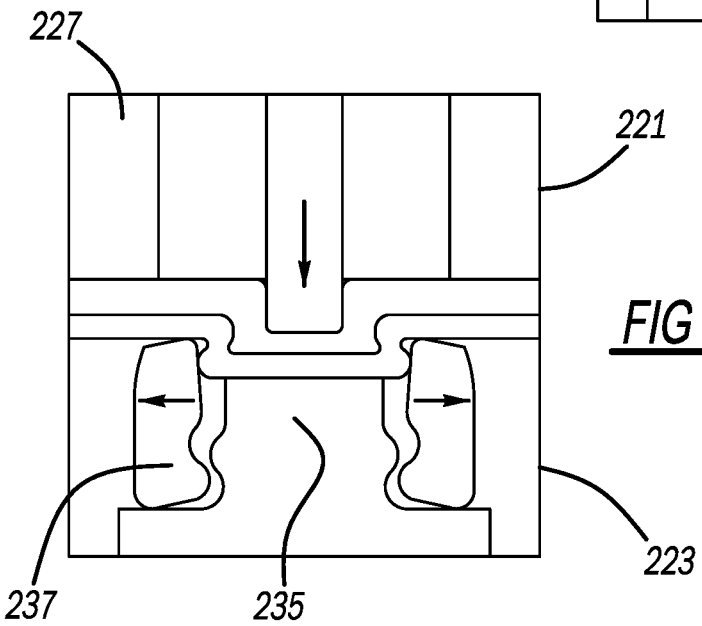
FIG. 21 is a diagrammatic cross-sectional view showing the clinching tools of the present clinching machine, in a fully clinch-forming condition.
Figure 22:
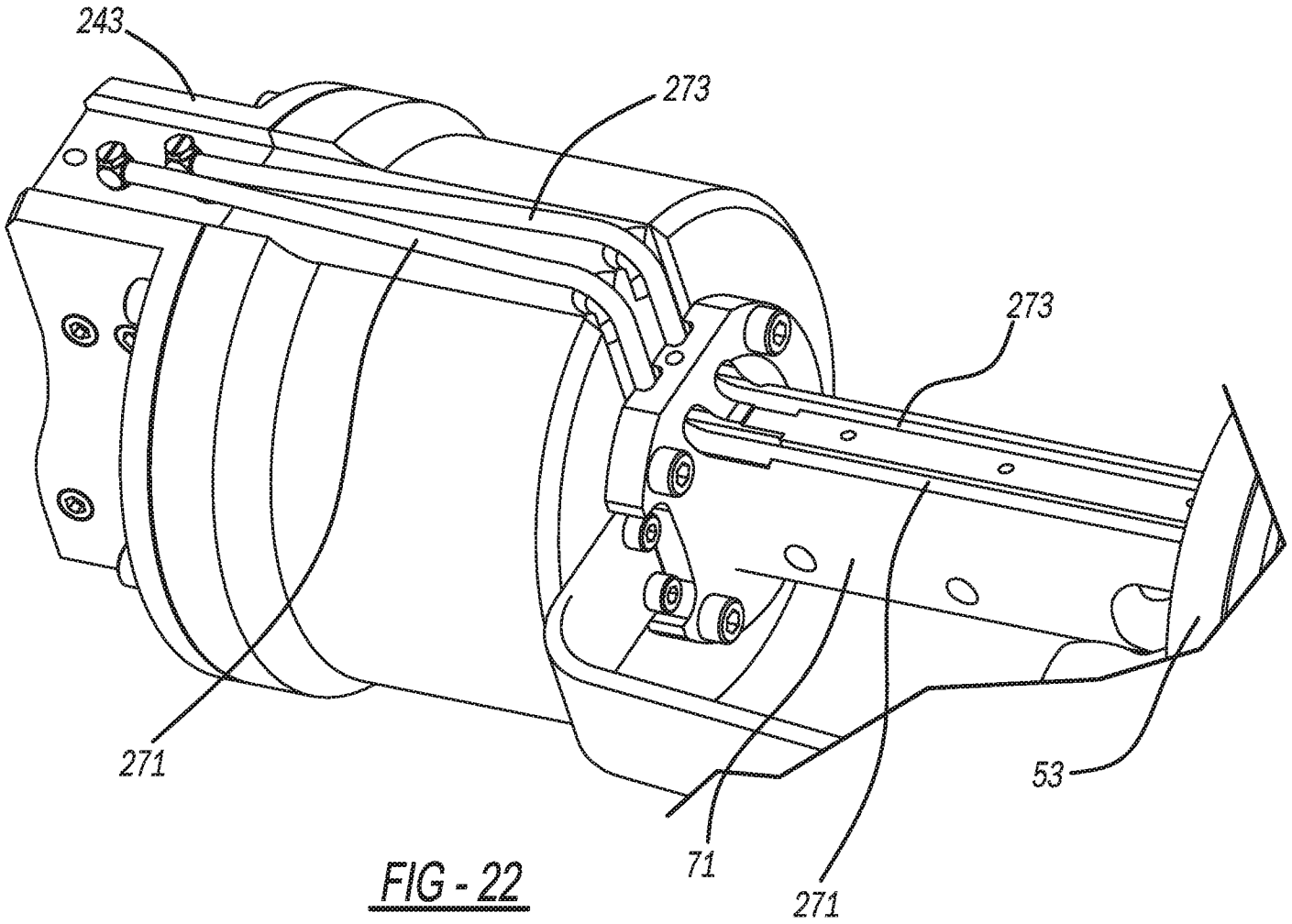
FIG. 22 is a front perspective view showing pneumatic tube routing at the piston assembly of the present clinching machine.
Figure 23:
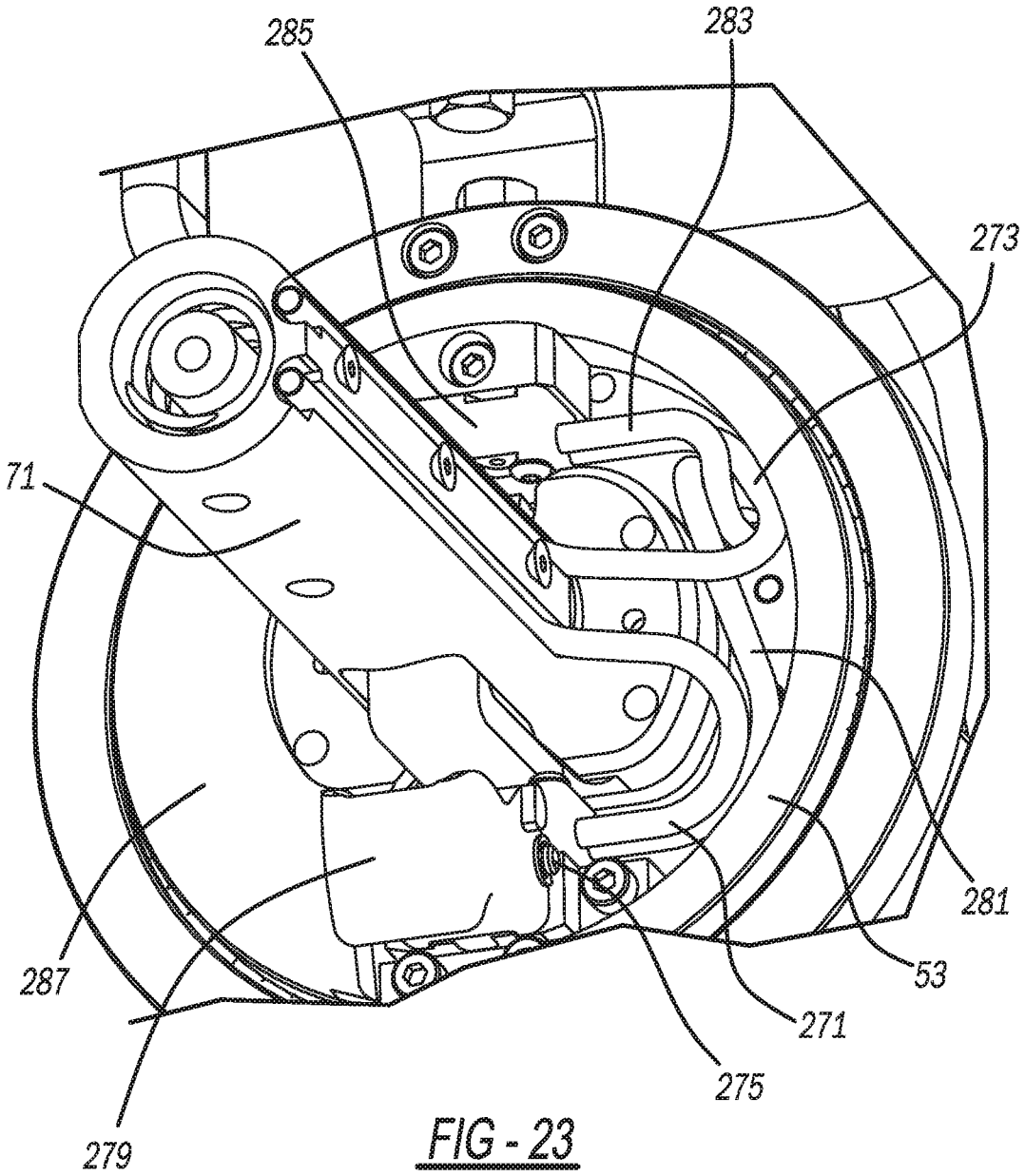
FIG. 23 is a rear perspective view showing the pneumatic tube routing at the pivot ring assembly of the present clinching machine.
Figure 24:
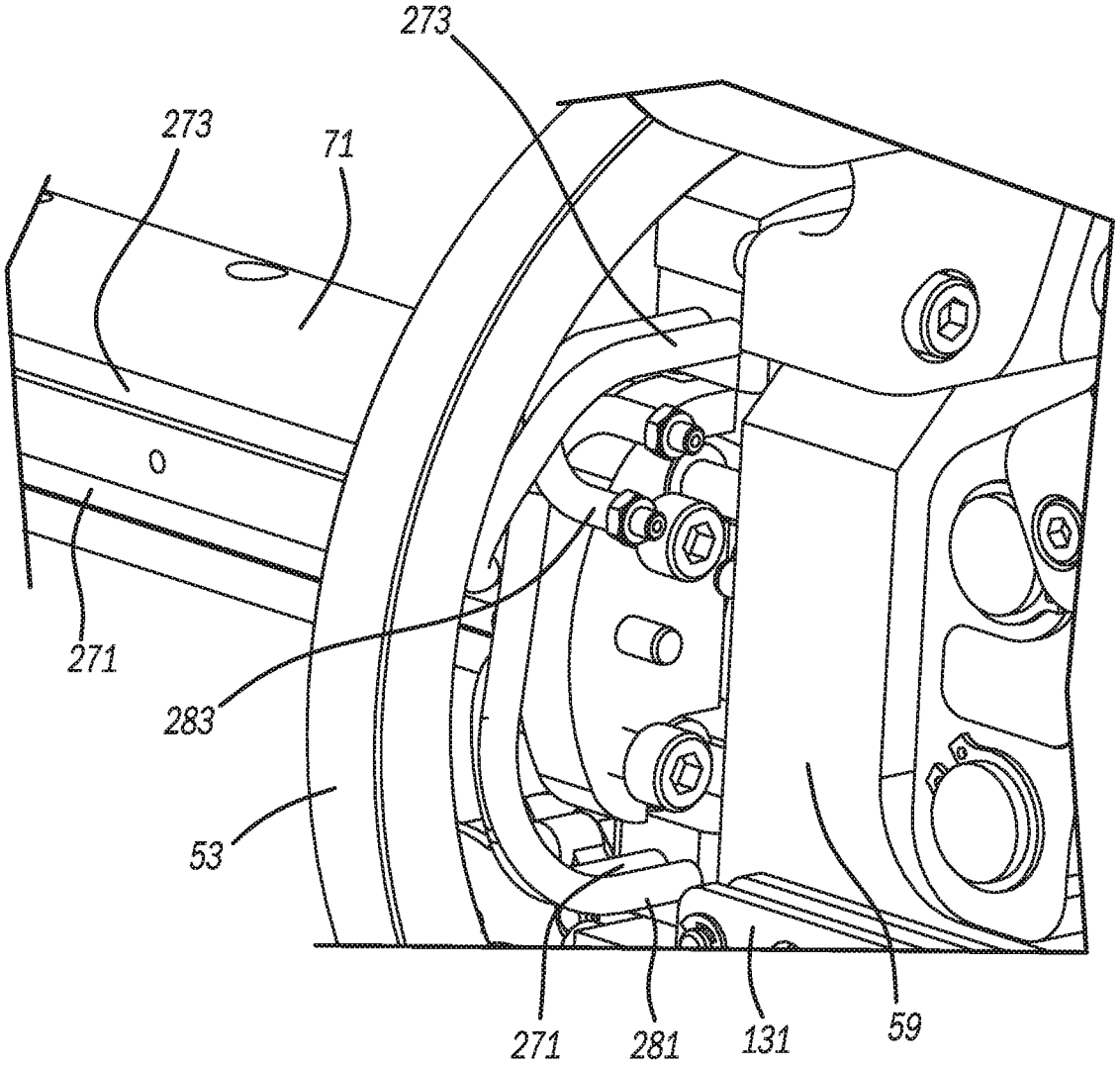
FIG. 24 is a front perspective view showing the pneumatic tube routing at the jaw assembly of the present clinching machine.
Figure 25:
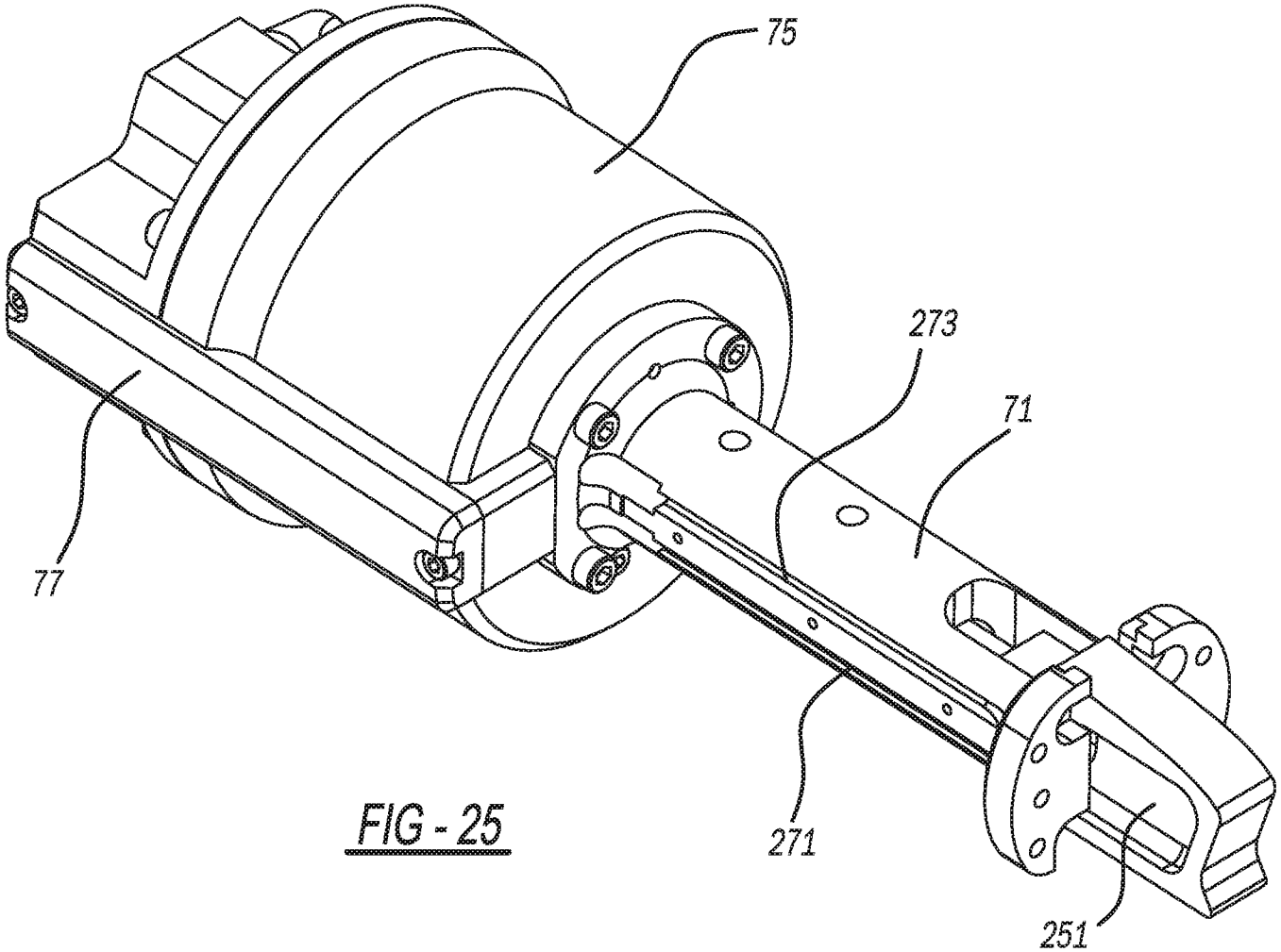
FIG. 25 is a front perspective view showing the piston assembly of the present clinching machine.
Figure 26:
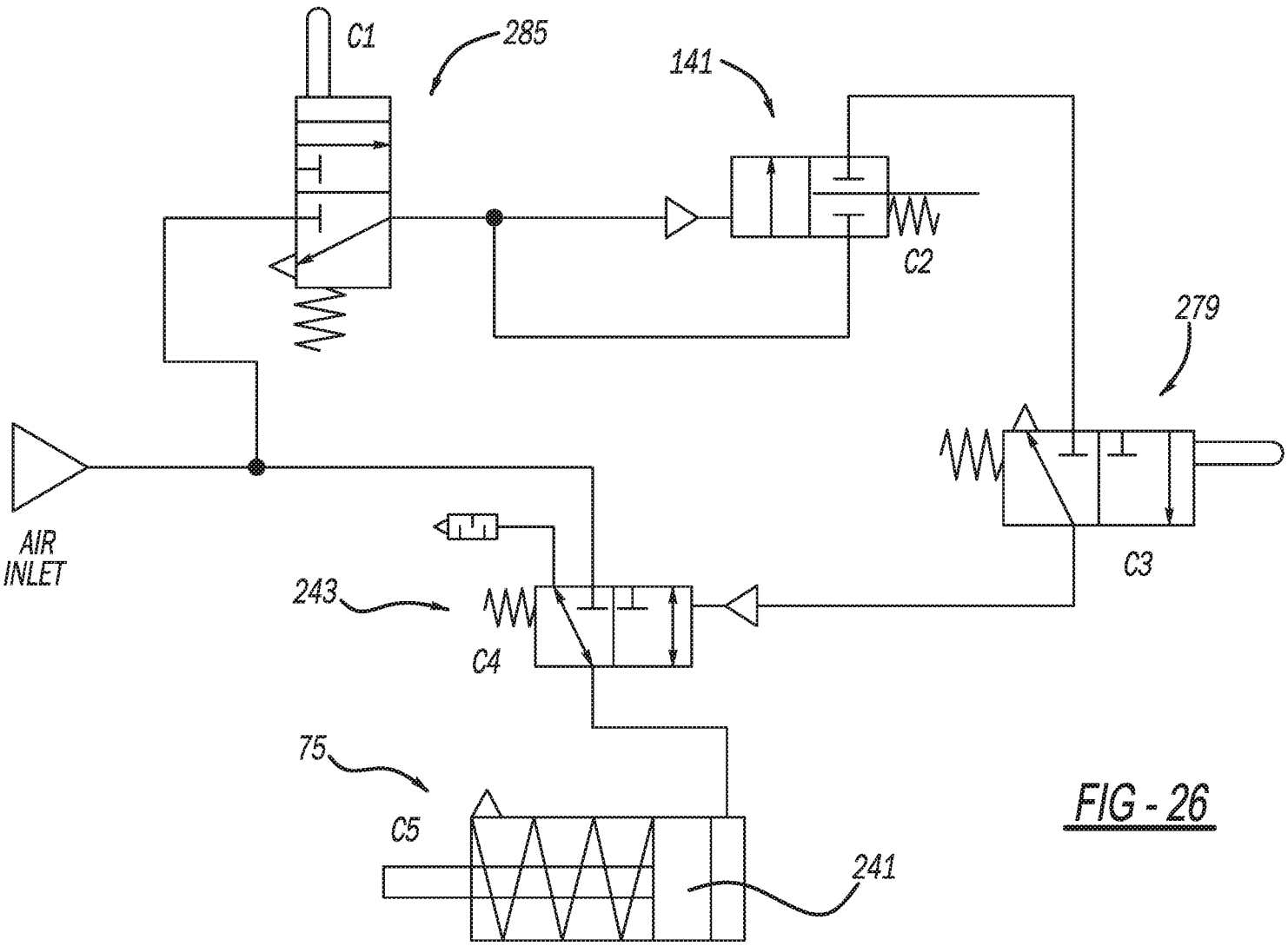
FIG. 26 is a diagrammatic view showing a pneumatic circuit diagram of the present clinching machine.
Figure 27:
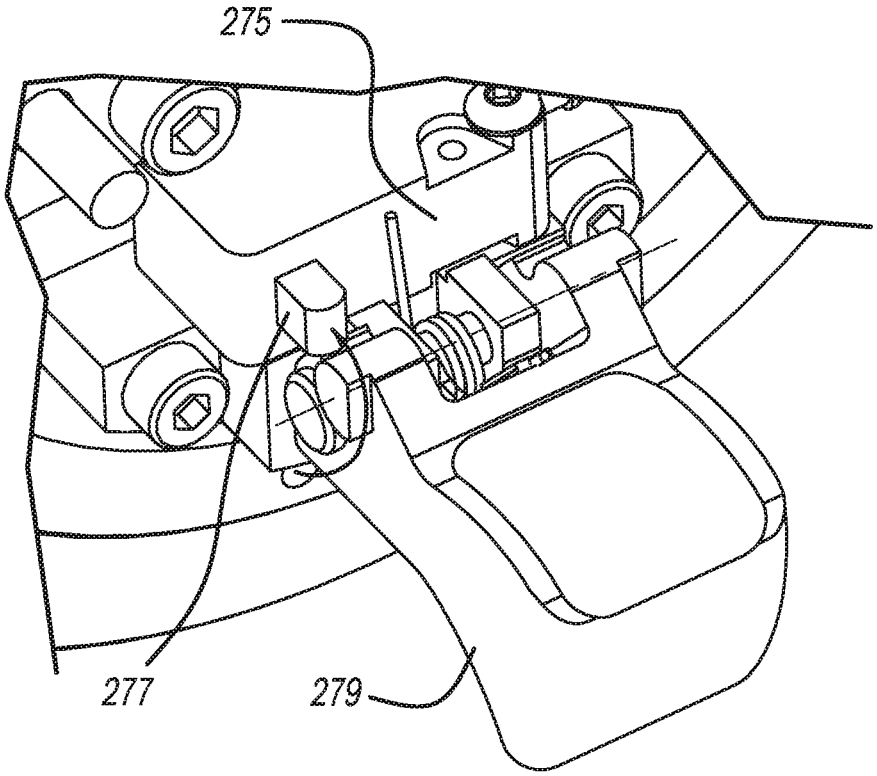
FIGS. 27 and 28 are rear perspective views showing a trigger and switch of the present clinching machine.
Figure 28:
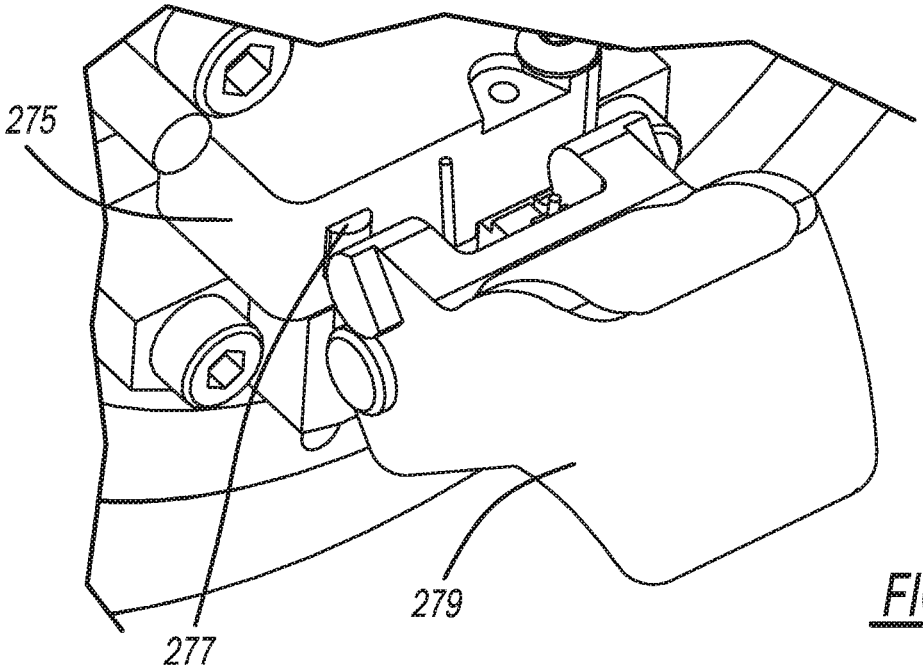
Figure 29:
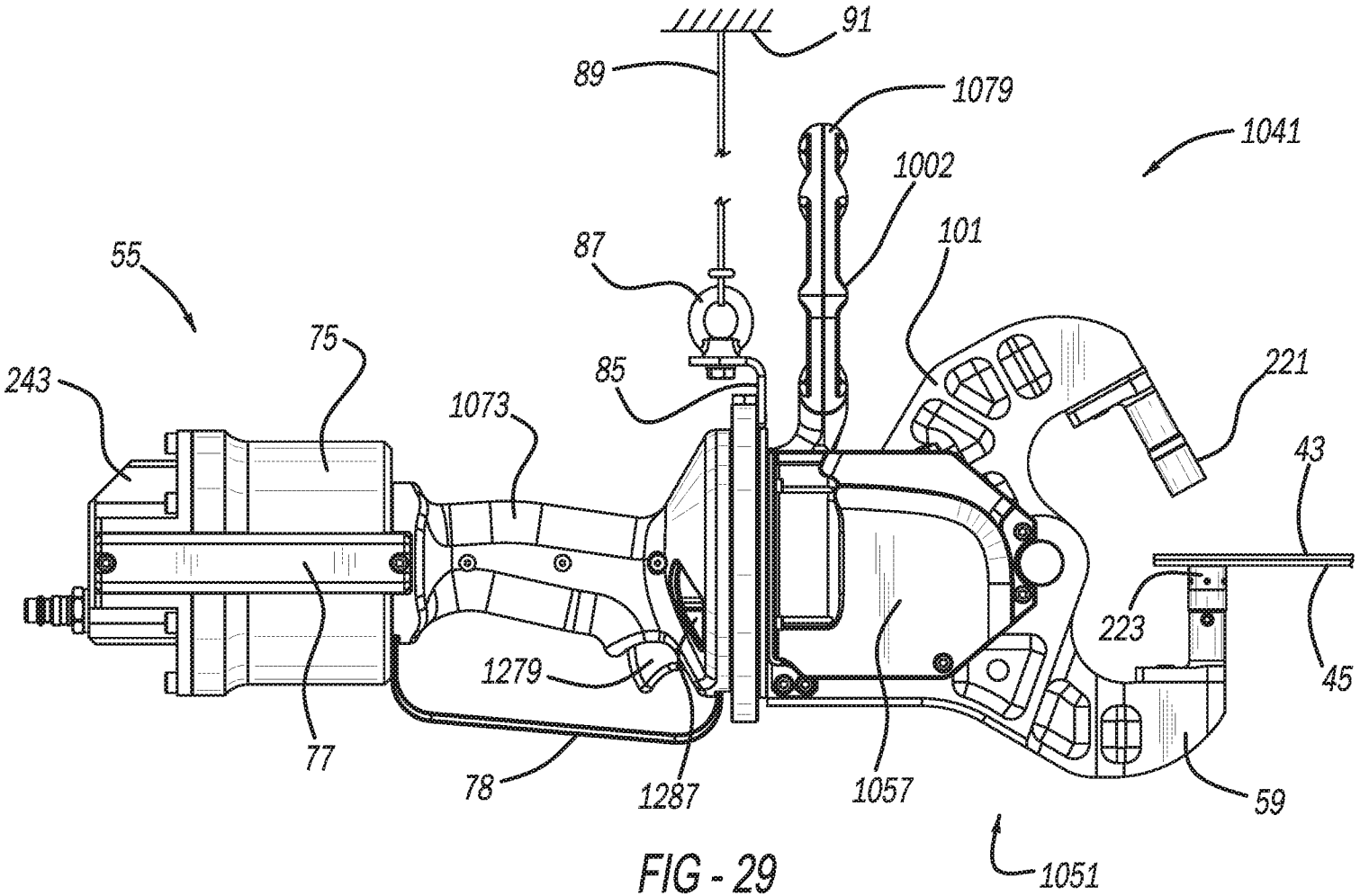
FIG. 29 is a side elevational view showing a second embodiment of the present clinching machine.
Figure 30:
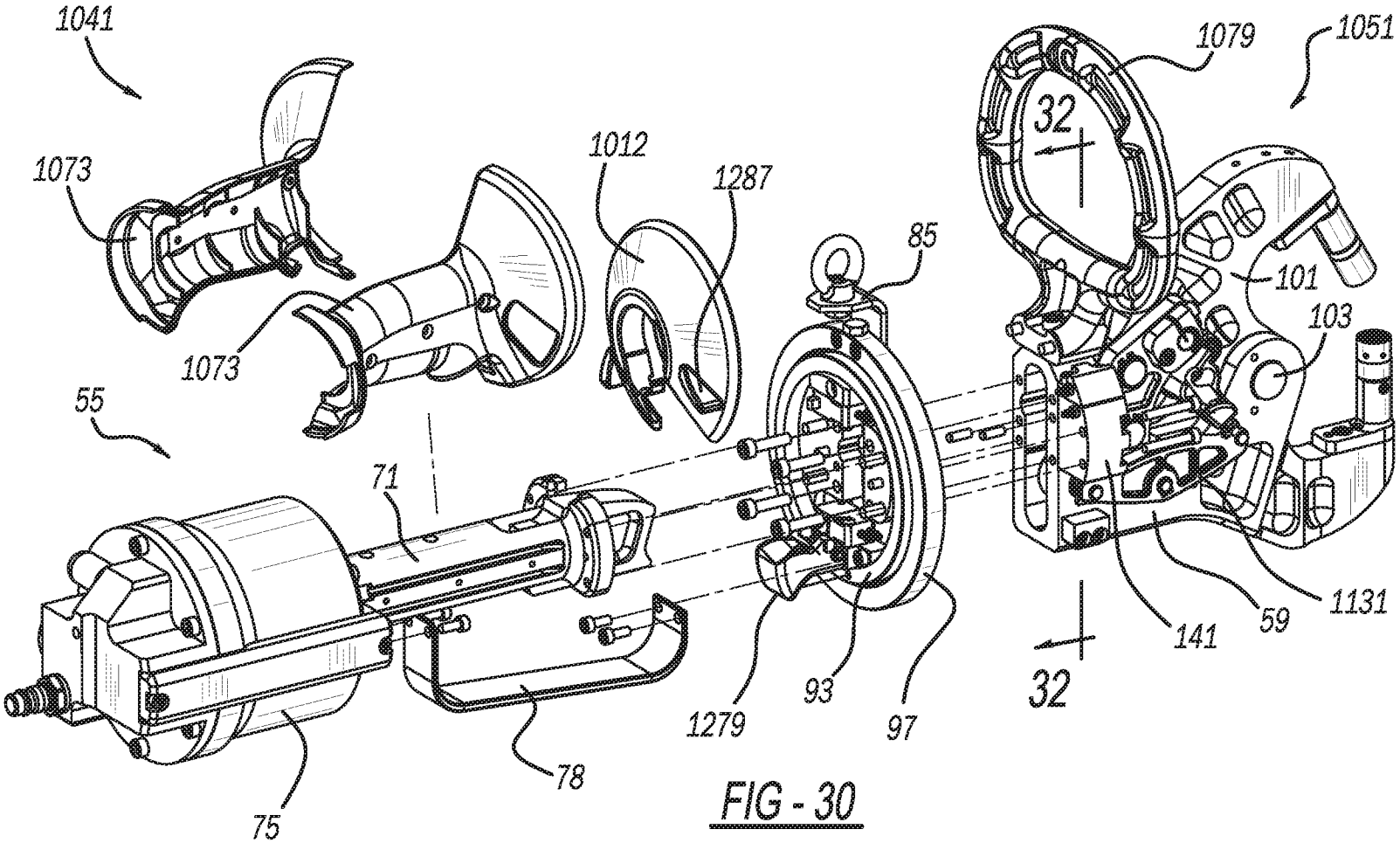
FIG. 30 is a partially exploded, rear perspective view showing the second embodiment of the present clinching machine.
Figure 31:
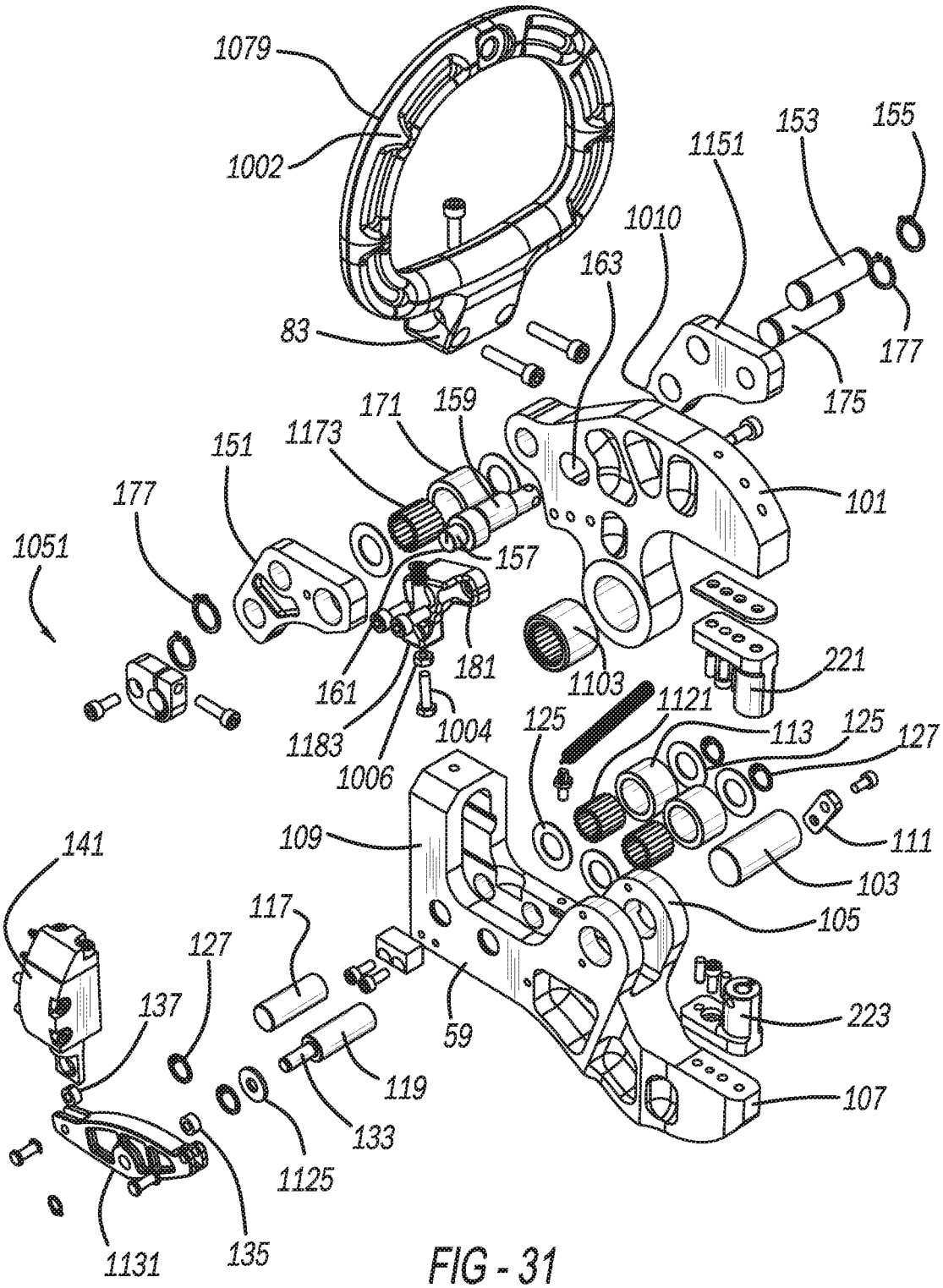
FIG. 31 is an exploded, front perspective view showing the second embodiment of the jaw assembly of the present clinching machine.
Figure 32:
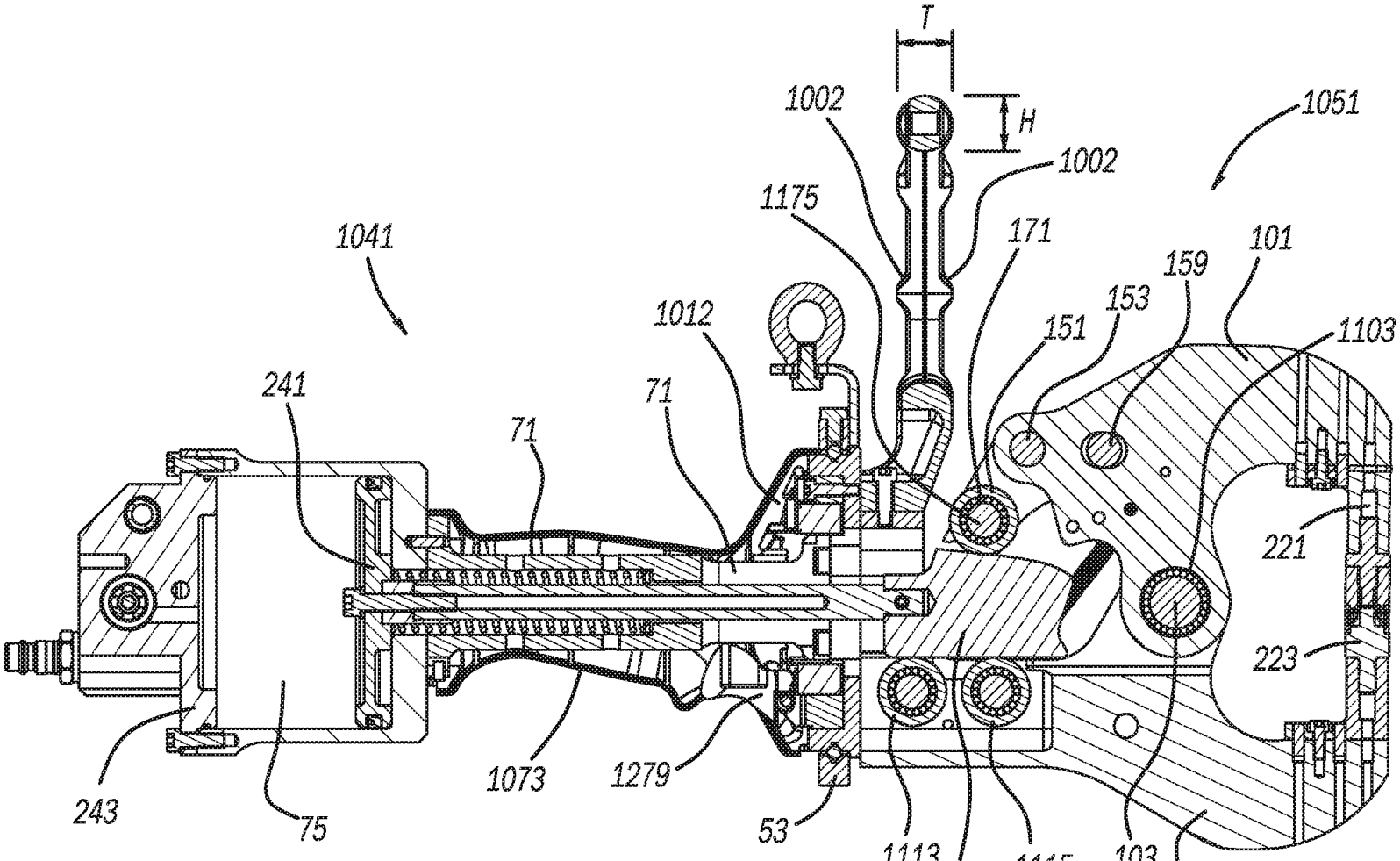
FIG. 32 is a cross-sectional view showing the second embodiment of the present clinching machine, with the jaws in the closed position.
Figure 33:
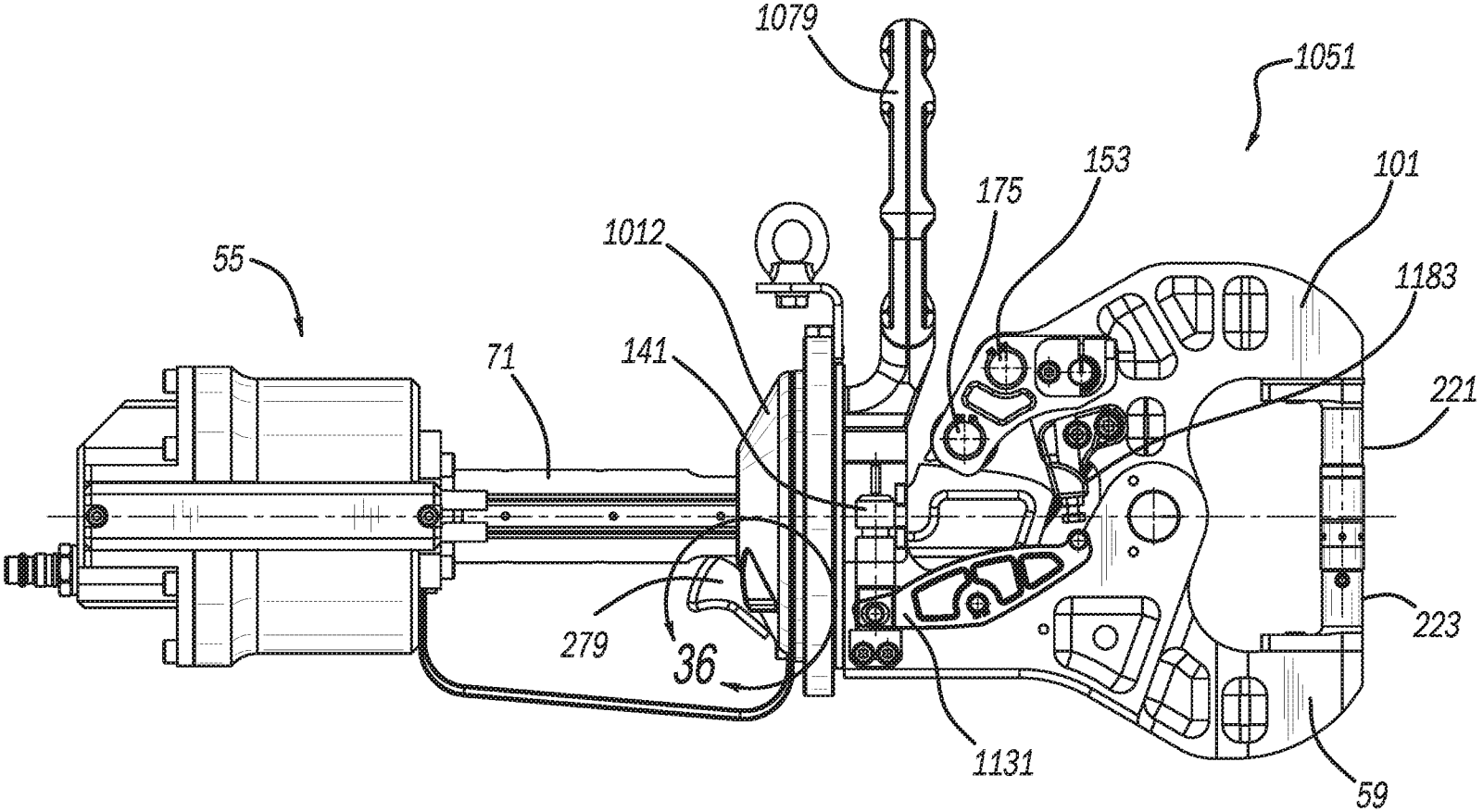
FIG. 33 is a side elevational view showing the second embodiment of the present clinching machine, with the central and forward housings removed, and with the jaws in the closed and workpiece clinching position.
Figure 34:
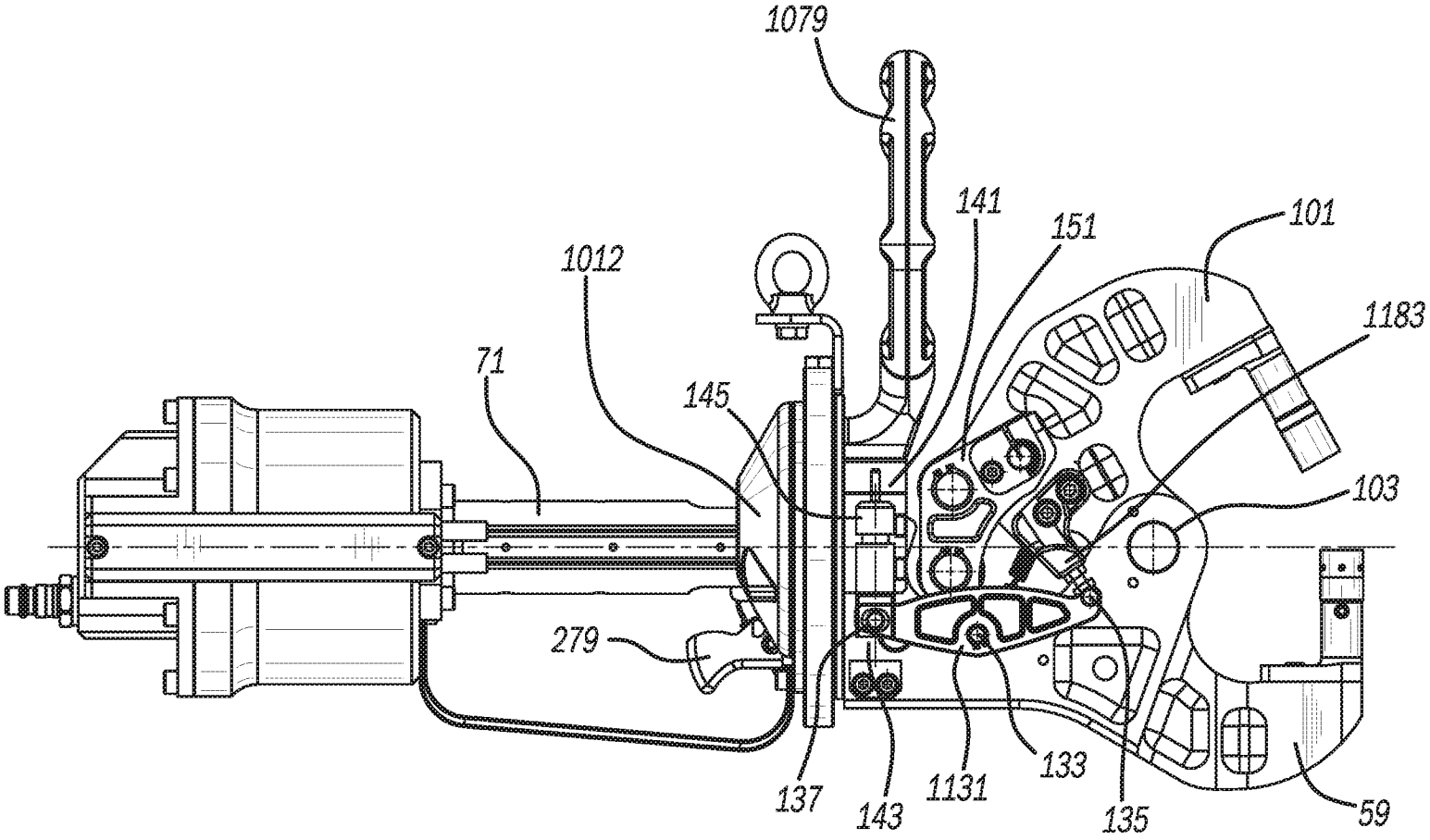
FIG. 34 is a side elevational view showing the second embodiment of the present clinching machine, with the central and forward housings removed, and with the jaws in the fully open position.
Figure 35:
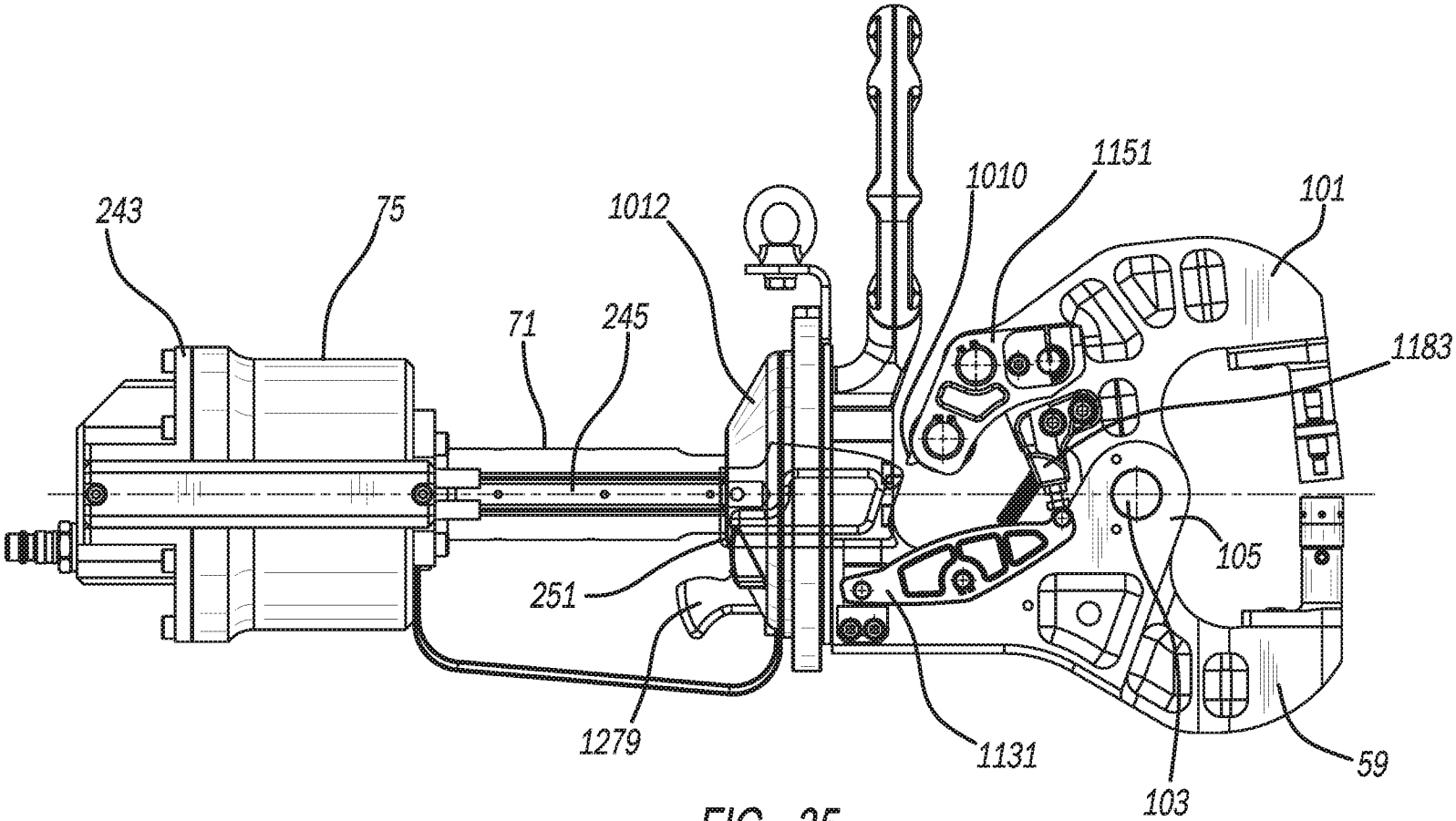
FIG. 35 is a side elevational view showing the second embodiment of the present clinching machine, with the central and forward housings removed, and with the jaws in the intermediate open position.
Figure 36:
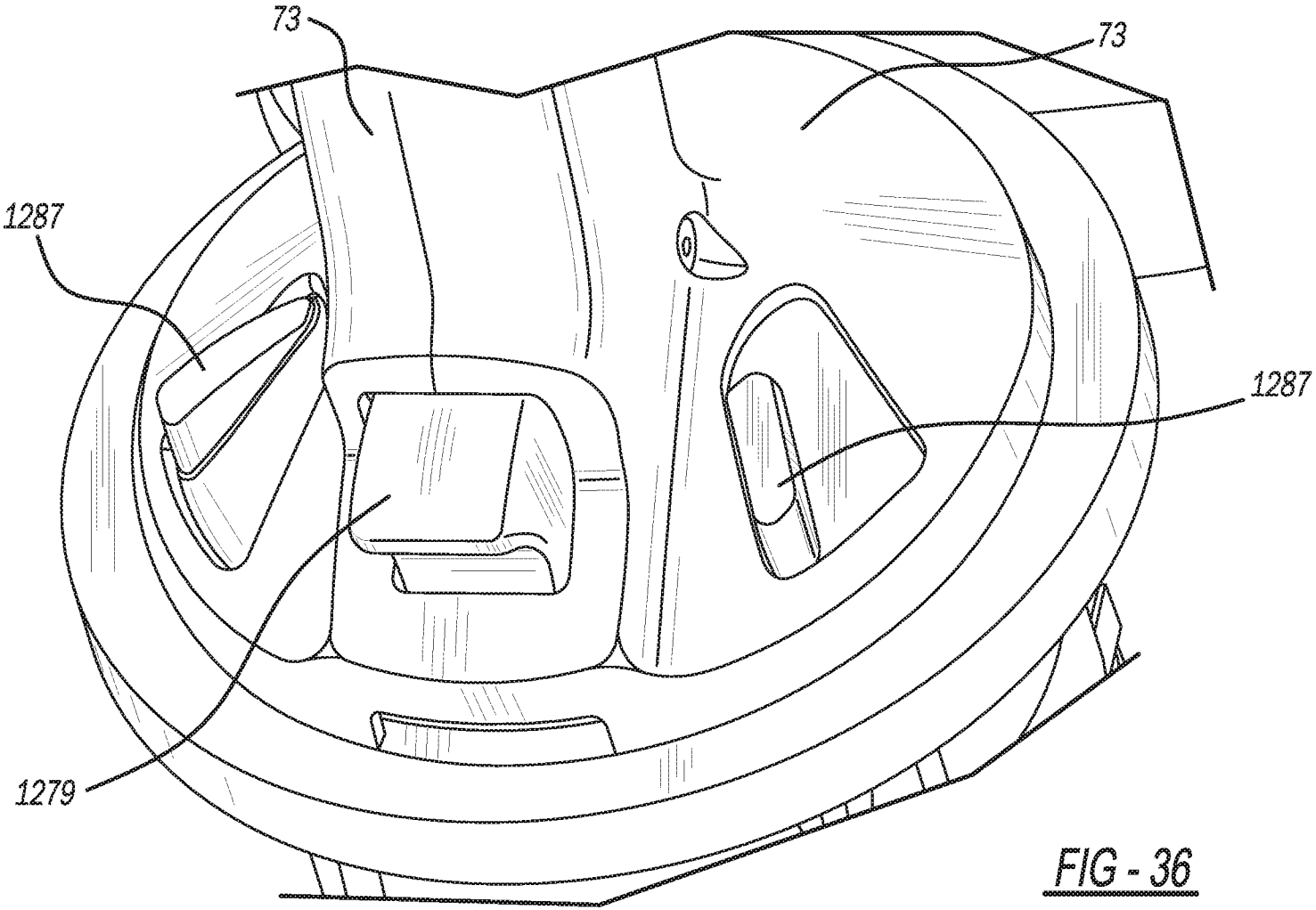
FIG. 36 is an enlarged and fragmentary perspective view, taken within circle 36 of FIG. 33, showing the second embodiment of the present clinching machine with an intermediate button in a first position.
Figure 37:
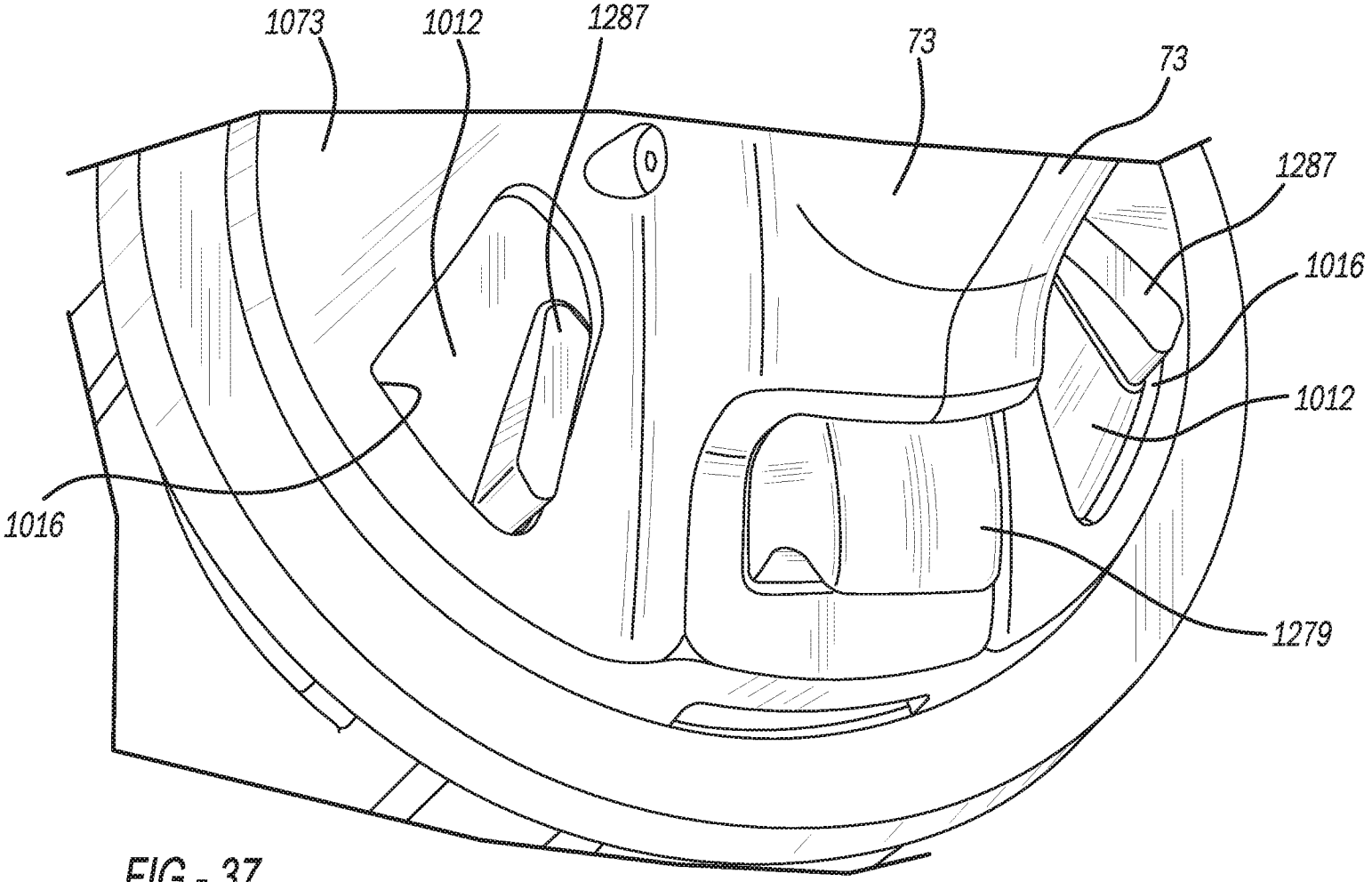
FIG. 37 is an enlarged and fragmentary perspective view, taken within circle 36 of FIG. 33, showing the second embodiment of the present clinching machine with the intermediate button in an opposite second position.

The clinching machine is operated as follows, with reference to FIGS. 5, 12-18 and 26. First, movable upper jaw 101 is initially in its fully open positions as shown in FIGS. 13 and 17, since air pressure has been released and a tensioning jaw spring 301 rotates upper jaw 101 about the main jaw pivot 103. Second, the user positions the hand-held clinching machine with the die assembly against an underside of the adjacent workpiece to be clinched. Third, the operator uses his or her thumb to manually rotate intermediate work position button 287 which actuates work position switch 285, which in turn, supplies air to upper arm work position valve C1 and 285. This valve 285 supplies air to valve C2 and 141 for extending piston 145, which downwardly rotates a rear end of rocker arms 131, such that a front end of the rocker arm upwardly pushes against abutment stop 183 to rotate upper jaw 101 to an intermediate open position. This intermediate open position provides a gap of about 6 mm between punch assembly 221 and die assembly 223, as is illustrated in FIGS. 14 and 18. Valve C1 and 285 passes air to power cycle switch C4 and 275 only when piston 145 is extended. Thus, the power cycle switch will only operate after this sequence has taken place.

Fourth, the operator manually rotates trigger C3 and 279 which actuates power cycle switch 275, which energize an integrated poppet valve C4 built into end cap 243. Fifth, when the poppet valve opens, the main power cylinder C5 and 75 are pneumatically pressurized to linearly advance the piston, piston rod and wedge block forward between roller 171 of upper arm on the one side and rollers 113 and 115 on the opposite side. More specifically, camming surface 253 of wedge block 251 forces upper jaw to rotate toward the closed and clinching position as can be seen in FIGS. 12, 15 and 16. This supplies at least 25 and more preferably 35 kN of clinching force between the punch and anvil.

Sixth, the moveable upper jaw and rocker arms separate during the power closing cycle and main return spring 247 retracts the piston, piston rod and camming wedge block when the trigger is manually released. This allows jaw spring 301 to reopen the upper jaw to the intermediate position where stop 183 again abuts against front end of rocker arms 131. Subsequent trigger actuation causes main piston 241 to again advance wedge block 251 and reclose the clinching tools for faster repeated clinch joint forming since the jaw does not need to open and close the full rotation were the stop not to abut against the rocker arm. This action beneficially provides very fast formation of multiple clinch joints in a "pecking manner" along the same workpiece combination.

A second exemplary embodiment of a clinching machine apparatus 1041 is illustrated in FIGS. 29-41. Clinching machine 1041 is used to fasten multiple workpiece sheets, preferably with a clinch joint. Furthermore, clinching machine 1041 is handheld and portable for use in quickly creating multiple clinching joints by moving the machine relative to stationary workpieces, although it is alternately envisioned that the present machine may be stationary while the workpieces are moved. The second embodiment is identical to the first embodiment discussed hereinabove except for the following features.

As can best be observed in FIGS. 29-32, a handle 1079 is fully enclosed and has a generally D-shape when viewed from the front or rear, which may be grabbed by a user's hand inserted therethrough during use of the machine. Handle 1079 has a greater height dimension H as compared to a slightly smaller dimensioned for-and-aft thickness T at the top and sides thereof. This achieves a greater handle stiffness in use. Moreover, a plurality of nodules 1002 project from front and rear faces of handle 1079 to provide an improved finger interface with the user's hand, thereby deterring slippage when grasped. Handle 1079 is preferably manufactured by 3D printing but may alternately be injection molded. Additionally, handle 1079 is preferably made as a single and integral polymeric piece without a metal core, in order to reduce weight and expense.

A removable polymeric, front exterior housing 1057 protectively covers sides of a jaw assembly 1051. Removable polymeric, central housings 1073 protectively cover a linearly elongated and centrally positioned spine 71 with fluid tubes 271 and 273 linearly extending therebetween. Spine 71 shields the fluid tubes from piston rod 245 which is movable within the spine. This allows easy installation and easy servicing of the fluid tubes, without exposing the tubes to sharp metal holes in the spine or adjacent parts.

Reference should now be made to FIGS. 31-35 to observe the differences to jaw assembly 1051. First, the second embodiment of a rocker arm 1131 is now of a single piece with bifurcated forward and rearward ends. Furthermore, an offset stop 1183 is adjustable by employing a downwardly projecting screw 1004 and a nut 1006. Screw 1004 has a lower head which operably abuts against bushing 135 attached to rocker arm 1131 while a shaft of screw 1004 is threaded for rotational movement within nut 1006 and an aligned bore within the generally L-shaped body of stop 1183. Moreover, a roller bearing 1103 has been added at main pivot 103 and full complement bearings have been used at 1121, 1173, 1113, 1115 and 1175. Additionally, a single washer 1125 is employed adjacent rocker arm 1131 and an oil fitting is no longer needed at main pivot 103. A generally angular fin 1010 projects from a lower edge of tail 1151 for contact against a side ledge of camming wedge block 251 in certain operating conditions.

FIGS. 33-41 illustrate an intermediate switch assembly employed with the second embodiment clinching machine. A collar 1012 has a rear face with a generally frusto-conical shape and a central opening surrounding a majority (and greater than a semi-circular portion) of its rotational axis and spine 73. Radial edges 1014 face each other at a lower section thereof and are spaced apart with trigger 1279 therebetween. User actuable buttons 1287 project from the rear face of collar 1012 and are accessible through openings 1016 within a matching generally frusto-conical bell segment of central housings 73. Thus, the user may engage either his right or left thumb against a side wall of a radially elongated one of the buttons 1287, while gripping the central housings with the same hand, to rotate the button approximately 20-30 degrees about its rotational axis. This button and collar rotation will cause an angled ramp 1018 on a front facing surface of collar 1012 to inwardly push a plunger 1020 of switch 285 after which a detented depression 1022 of collar 1012 will provide a clicking feel and temporarily retain plunger 1020 in its depressed position as can be observed in FIG. 40. Plunger depression activates intermediate work position switch 285 which then activates valve 141 to move rocker arm 1131. Reverse rotation of button 1287 and collar 112 allows plunger 1020 to return to its nominal extended and deactivated position, via spring biasing within switch 285. Plunger 1020 can return to the nominal position since there is a gap between the plunger and an adjacent facing surface area 1022 of collar 1012, as can best be seen in FIG. 41.

Figure 38:
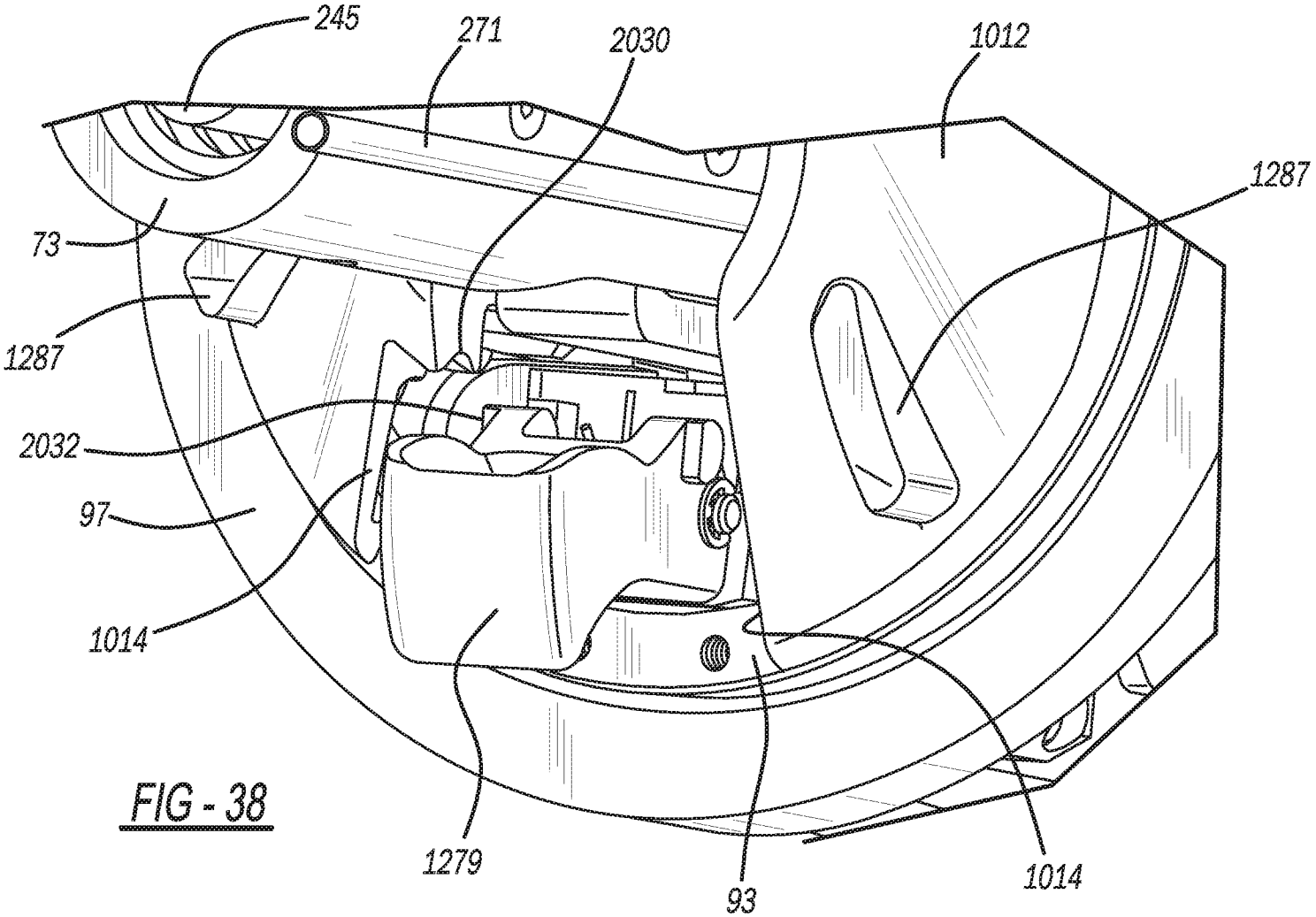
FIG. 38 is an enlarged and fragmentary perspective view, taken within circle 36 of FIG. 33, showing the second embodiment of the present clinching machine, with the central housing removed and the intermediate button in the first position.
Figure 39:
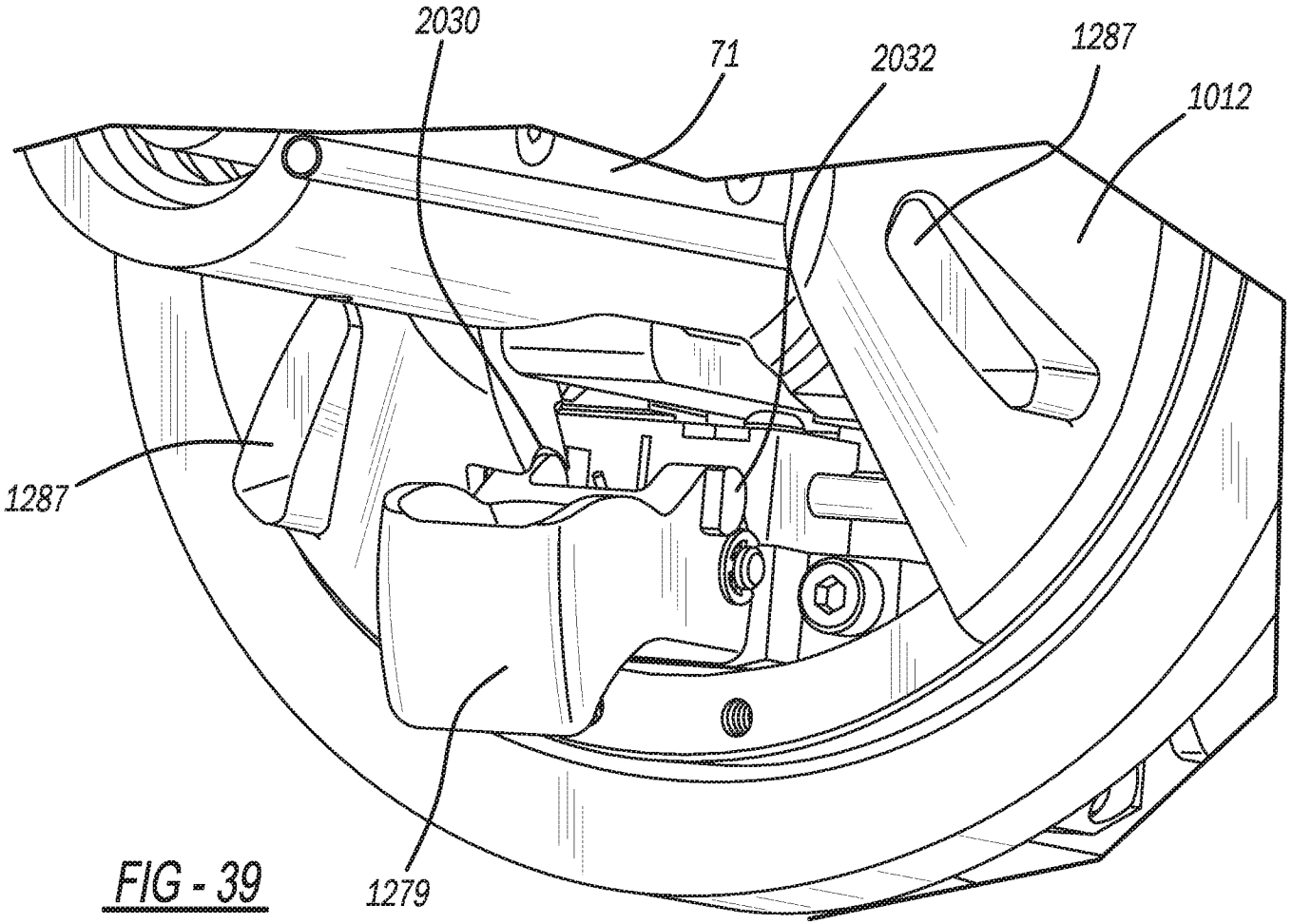
FIG. 39 is an enlarged and fragmentary perspective view, taken within circle 36 of FIG. 33, showing the second embodiment of the present clinching machine, with the central housing removed and the intermediate button in the second position.
Figure 40:
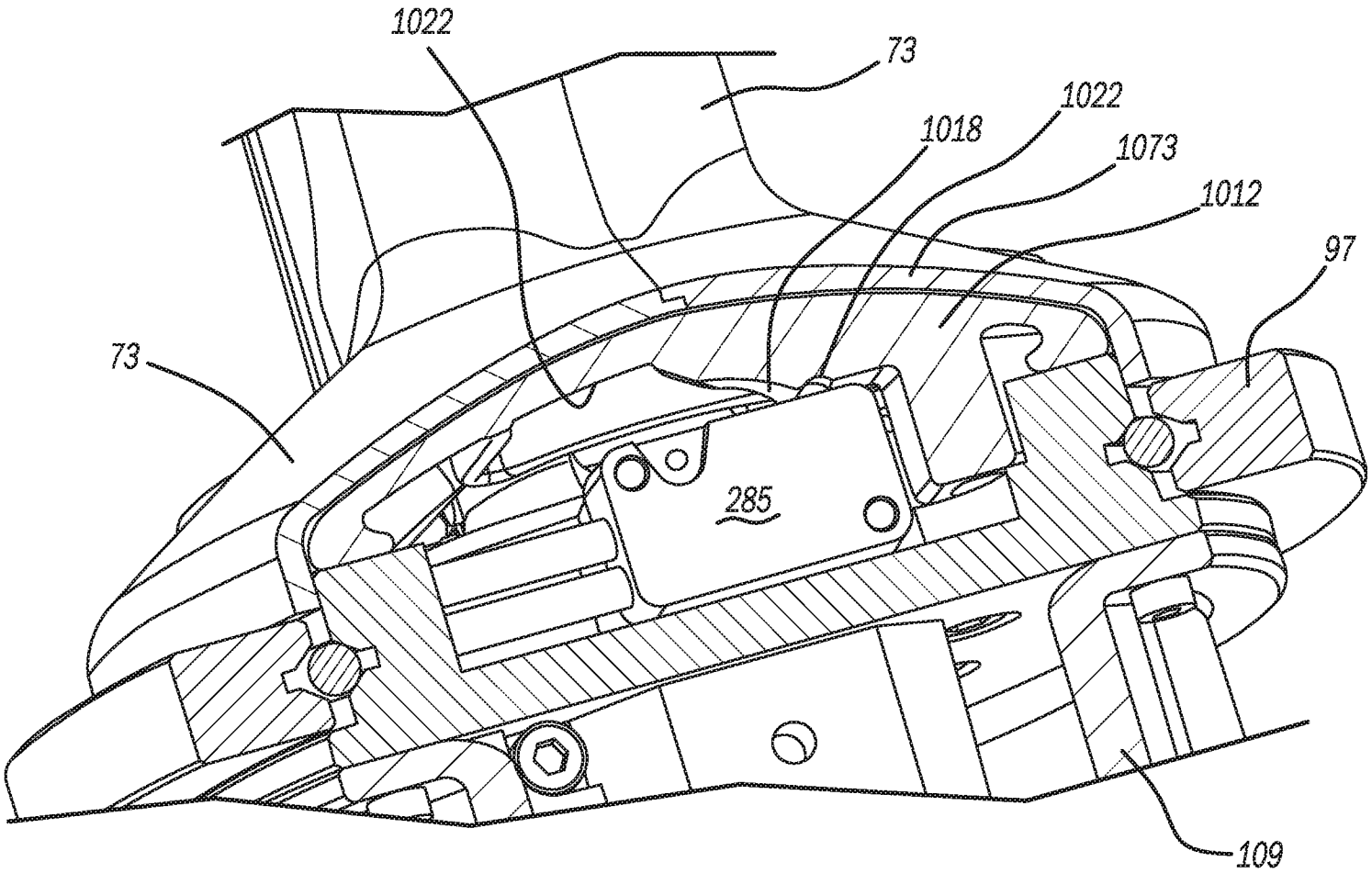
FIG. 40 is a partially sectioned, perspective view showing the second embodiment of the present clinching machine with an intermediate switch in an activated condition.
Figure 41:
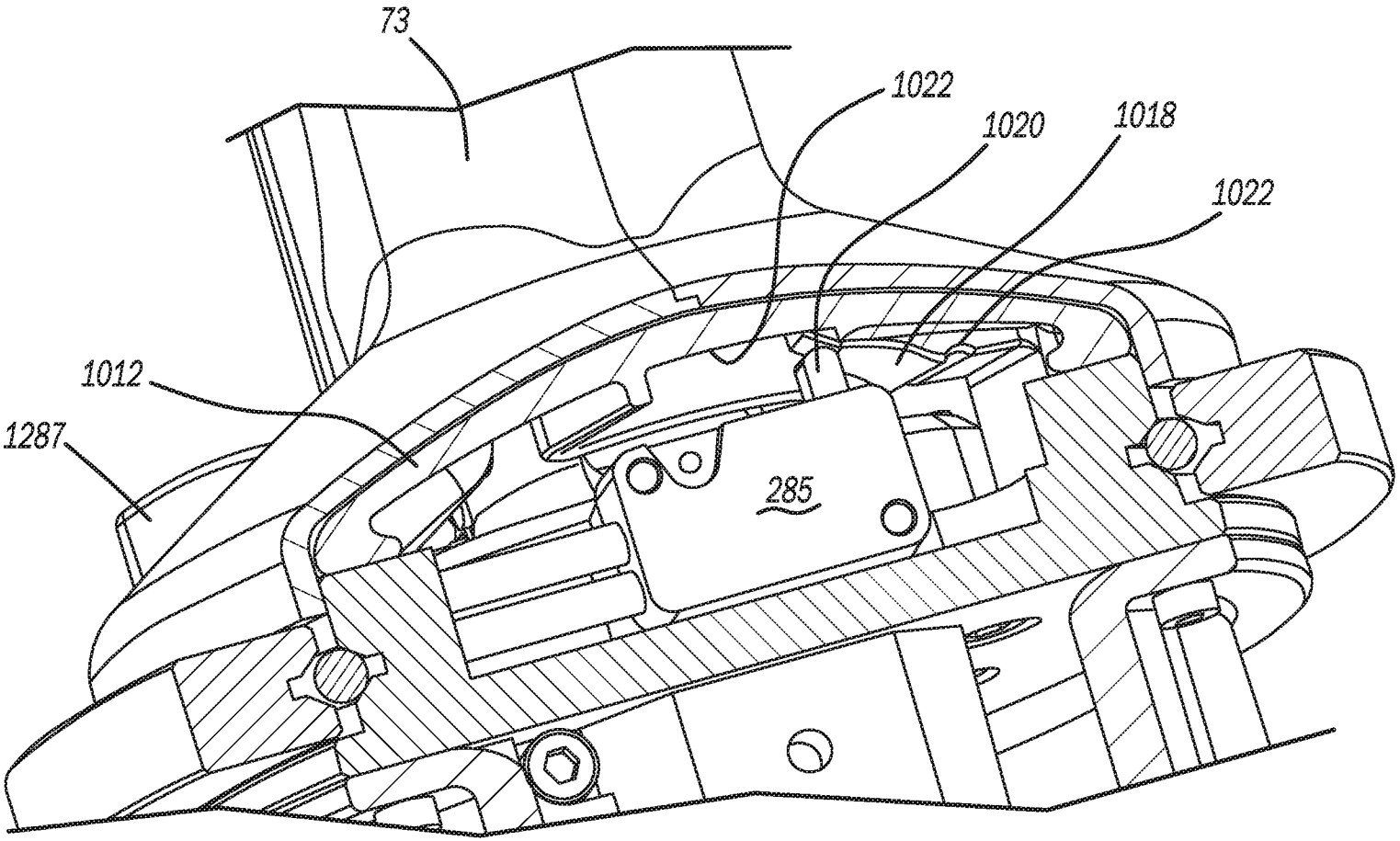
FIG. 41 is a partially sectioned, perspective view showing the second embodiment of the present clinching machine with the intermediate switch in a deactivated condition.

FIGS. 38 and 39 show a lockout structure to block trigger depression unless the buttons of intermediate switch assembly have been previously rotated to their intermediate opening position. Edge 1014 of collar 1012 has a valley or catch 2030 which is openly accessible in a downward direction. Each lateral wall of trigger 1279 further has a matching ear 2032, with an arcuate upper edge, that is received within catch 2030 if the catch is in a rotational position above the associated ear, as viewed in FIG. 39. This prevents depression of trigger 1279 and the associated switch. But when collar is rotated to the position shown in FIG. 38, ear 2032 is clear of catch 2030 and the trigger is allowed to fully upwardly rotate to activate its jaw-closing switch.

While specific exemplary constructions and methods have been disclosed, other variations may be employed. For example, different pneumatic (or less preferably, hydraulic) fluid tube, switch and valve placement and actuation may be provided although some of the advantages may not be achieved. In another example, a piston moved block may have an internal camming slot with a pin-type follower; however, certain benefits may not be realized. As another alternative, an electromagnetic (instead of the disclosed fluid) actuator may be used with certain features, such as the intermediate switch assembly and/or rocker arm features, among others. Moreover, both arms can pivot in a different embodiment but such is likely more expensive and has a larger open packaging size.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A clinching machine comprising:

(a) a piston cylinder;

(b) a piston moveable within the cylinder;

(c) multiple jaws, at least one of which is moveable relative to the piston cylinder;

(d) a workpiece clinching punch mounted to one of the jaws;

(e) a workpiece clinching die mounted to another of the jaws;

(f) a cam moveable with the piston, between a retracted position and an advanced position, to cause opening and closing of the at least one moveable jaw, the cam being located between portions of the jaws when the cam is in at least one of its positions; and (g) a rocker arm rotatable about a pivot from a first rocking orientation to a second rocking orientation independent of movement of the cam, the first rocking orientation allowing the at least one moveable jaw to move to a fully open position, and the second rocking orientation allowing the at least one moveable jaw to move to an intermediate open position which is less than the fully open position.

2. The clinching machine of claim 1, further comprising:

a ring located between the jaws on one side and the piston cylinder on an opposite side;

a single piece and entirely polymeric handle coupled to the ring, the handle having a curved D-shape; and a user-operable trigger coupled to the ring opposite the handle;

wherein the clinching machine is hand-held and portable.

3. The clinching machine of claim 1, wherein:

the rocker arm is a lever including a forward end operably abutting a stop extending from the at least one moveable jaw, and a rearward end coupled to a fluid actuator located between the piston and the jaws;

the pivot of the rocker arm is between the ends of the rocker arm; and axes of the rocker arm and a rotational pivot coupling the jaws, are parallel.

4. The clinching machine of claim 1, further comprising;

a hand-held spine;

one of the jaws operably rotating while an opposite of the jaws being stationary relative to the piston cylinder;

the die being mounted adjacent a forward end of the opposite jaw, which is stationary, and the punch being mounted adjacent a forward end of the moveable jaw;

the stationary jaw being coupled to a forward end of the spine and the piston cylinder being coupled to a rearward end of the spine;

an enclosed user-graspable handle coupled to the spine and the stationary jaw, the user-graspable handle being wider than an exterior surface of the piston cylinder;

a piston rod being linearly moveable within the spine;

a user-operable trigger and an enclosed trigger guard coupled to the spine opposite the user-graspable handle; and the pivotable rocker arm being located between the forward end of the spine and a rotational coupling between the jaws.

5. The clinching machine of claim 1, further comprising:

a moveable tail coupled to an end of the moveable jaw opposite the punch;

a cam follower coupled to the tail and operably contacting against the cam when the cam is advanced to rotate the moveable jaw to a closed and workpiece clinching position; and a pin including an offset lobe which is rotatable to adjust an orientation of the tail relative to the moveable jaw.

6. The clinching machine of claim 1, further comprising:

a piston return spring partially located with an elongated and hollow spine, the spine extending between the piston cylinder and a gimble ring assembly to which at least one of the jaws is coupled;

a channel extending along a length of the spine; and a pneumatic tube routed in the channel.

7. The clinching machine of claim 1, further comprising:

a fluid-operated moving jaw position valve;

a user-activatable, upper jaw position actuator openly actuating the moving jaw position valve; and a spring opening the at least one moveable jaw to the intermediate open position when the moving jaw position valve rotates the rocker arm to the second rocking orientation.

8. The clinching machine of claim 7, further comprising:
a user-activatable trigger;
a main power switch, actuated by the trigger, causing fluid to advance the piston and the cam which rotates the at least moveable jaw toward an opposite jaw to create a workpiece clinch joint;
a cam follower coupled to the moveable jaw; and
the cam being a wedge block with a peripheral camming surface against which the cam follower rides.

9. A clinching machine comprising:
(a) a piston cylinder;
(b) a piston moveable within the cylinder;
(c) multiple jaws, at least one of which is moveable relative to the piston cylinder;
(d) a workpiece clinching punch mounted to one of the jaws;
(e) a workpiece clinching die mounted to another of the jaws;
(f) a camming wedge moveable with the piston, between a retracted position and an advanced position, to cause opening and closing of the at least one moveable jaw, the camming wedge being located between portions of the jaws when the camming wedge is in at least one of its positions; and
(g) a moveable tail coupled to an end of the moveable jaw opposite the punch;
(h) a cam follower coupled to the tail and operably contacting against the camming wedge when the wedge is advanced to rotate the moveable jaw to a closed and workpiece clinching position; and
(i) a pin including an offset lobe which is rotatable to adjust an orientation of the tail relative to the moveable jaw.

10. The clinching machine of claim 9, further comprising;
a hand-held spine;
one of the jaws operably rotating while an opposite of the jaws being stationary relative to the piston cylinder;
the die being mounted adjacent a forward end of the opposite jaw, which is stationary, and the punch being mounted adjacent a forward end of the moveable jaw;
the stationary jaw being coupled to a forward end of the spine and the piston cylinder being coupled to a rearward end of the spine;
an enclosed user-graspable handle coupled to the spine and the stationary jaw, the user-graspable handle being wider than an exterior surface of the piston cylinder;
a piston rod being linearly moveable within the spine;
a user-operable trigger and an enclosed trigger guard coupled to the spine opposite the user-graspable handle; and
a pivotable rocker arm being located between the forward end of the spine and a rotational coupling between the jaws.

11. A clinching machine comprising:
(a) an actuator;
(b) multiple jaws, at least one of which is moveable relative to the actuator;
(c) a workpiece clinching punch mounted to one of the jaws;
(d) a workpiece clinching die mounted to another of the jaws;
(e) a user-moveable trigger operable to cause the actuator to move the at least one moveable jaw from a fully open position to a workpiece-clinching position; and
(f) a user-moveable button operable to limit opening of the at least one moveable jaw to an intermediate open position which is less than the fully open position;
(g) an elongated spine which couples the actuator to the jaws;
(h) the button being rotatable about an axis which is coaxial with the spine; and
(i) the button and the trigger being located adjacent a forward end of the spine with the trigger being moveable toward the spine.

12. The clinching machine of claim 11, further comprising:
an intermediate position switch;
multiples of the button being located on a rear face of a rotatable collar, the collar forming more than a semicircle surrounding a portion of the spine; and
a ramp and a detent depression located on a front face of the collar which operably activate and deactivate the intermediate position switch.

13. The clinching machine of claim 11, further comprising:
a cam moveable with the actuator, between a retracted position and an advanced position, to cause opening and closing of the at least one moveable jaw, the cam being located between portions of the jaws when the cam is in at least one of its positions; and
a rocker arm rotatable about a pivot from a first rocking orientation to a second rocking orientation, the first rocking orientation allowing the at least one moveable jaw to move to the fully open position, and the second rocking orientation allowing the at least one moveable jaw to move to the intermediate open position.

14. The clinching machine of claim 13, further comprising:
a fluid-operated moving jaw position valve activated by movement of the button; and
a spring opening the at least one moveable jaw to the intermediate open position when the moving jaw position valve rotates the rocker arm to the second rocking orientation.

15. A clinching machine comprising:
(a) an actuator;
(b) multiple jaws, at least one of which is moveable relative to the actuator;
(c) a workpiece clinching punch mounted to one of the jaws;
(d) a workpiece clinching die mounted to another of the jaws;
(e) a user-moveable trigger operable to cause the actuator to move the at least one moveable jaw from a fully open position to a workpiece-clinching position;
(f) a user-moveable button operable to limit opening of the at least one moveable jaw to an intermediate open position which is less than the fully open position;
(g) an elongated and hollow, hand-held spine;
(h) one of the jaws operably rotating while an opposite of the jaws being stationary relative to the actuator;
(i) the clinching die mounted adjacent a forward end of the stationary jaw;
(j) the clinching punch being mounted adjacent a forward end of the at least one moveable jaw;
(k) a piston cylinder coupled to a rearward end of the spine and the stationary jaw being coupled to a forward end of the spine;
(l) an enclosed user-graspable handle coupled to at least one of the spine and the stationary jaw, the handle being wider than an exterior surface of the actuator; and
(m) the user-operable trigger and an enclosed trigger guard coupled to the spine opposite the handle.

16. The clinching machine of claim 15, further comprising:

an intermediate position switch;

multiples of the button being located on a rear face of a rotatable collar, the collar forming more than a semicircle surrounding a portion of the spine; and a ramp and a detent depression located on a front face of the collar which operably activate and deactivate the intermediate position switch.

17. The clinching machine of claim 15, further comprising:

a spring including a first end attached to the at least one moveable jaw and a second end coupled to the stationary jaw;

the handle being located entirely rearward of the ends of the spring, and the handle being located forward of the trigger;

the handle being located above the spine and a pivot of the at least one movable jaw, and the trigger being located below the spine; and a fore-and-aft curved, polymeric housing covering the spine.

18. The clinching machine of claim 15, further comprising:

a piston rod;

a camming wedge block coupled to a distal end of the piston rod, the camming wedge blocking including a camming surface;

a piston, located in the piston cylinder, operably moving the piston rod between extended and retracted positions; and rollers contacting the wedge block when in an advanced position.

19. A machine comprising:

(a) a piston cylinder;

(b) a piston longitudinally moveable within the cylinder;

(c) multiple jaws, at least one of which being moveable relative to the piston cylinder;

(d) a workpiece fastening punch mounted to one of the jaws;

(e) a workpiece fastening die mounted to another one of the jaws;

(f) a longitudinally elongated spine, the cylinder being coupled adjacent a rear end of the spine and the jaws being coupled adjacent a front end of the spine;

(g) a user-grippable housing covering the spine;

(h) multiple fluid-carrying tubes located between the spine and the housing along an entire longitudinal distance of a user-grippable area of the housing, at least one of the tubes being coupled to the cylinder;

(i) a user-actuable switch located adjacent the front end of the spine; and (j) the machine being hand-held and portable.

20. The machine of claim 19, further comprising:

a fluid-operated moving jaw position valve coupled to at least one of the tubes; and a spring opening the at least one moveable jaw to an intermediate open position, which is less than a fully open position, when the moving jaw position valve moves an arm which blocks the moveable jaw from opening to the fully open position.

21. The machine of claim 19, further comprising:

a cam;

a piston rod coupling the cam to the piston;

a user-activatable trigger;

the switch, actuated by the trigger, causing fluid to advance the piston and the cam which rotates the at least one moveable jaw toward an opposite jaw to create a workpiece clinch joint;

the piston rod moveable within a hollow center of the spine, the tubes being external to the hollow center of the spine;

a cam follower coupled to the moveable jaw; and the cam being a wedge block with a peripheral camming surface against which the cam follower rides.

22. The machine of claim 19, wherein:

the punch is a sheet metal clinching punch mounted to a rotatable one of the jaws;

the die is a sheet metal clinching die, including a central anvil and moveable die blades, mounted to a stationary one of the jaws; and the housing is polymeric, elongated and surrounds the spine.

23. The machine of claim 19, further comprising:

a piston return spring partially located within a hollow center of the spine;

a piston rod linearly moveable within the hollow center of the spine, the rod being operable driven by the piston;

a gimble ring assembly coupled to at least one of the jaws adjacent the front end of the spine;

at least one channel externally extending along a length of the spine; and the tubes are pneumatic tubes routed in the at least one channel.

24. The machine of claim 19, further comprising:

a gimble ring assembly coupled to at least one of the jaws adjacent the front end of the spine; and the tubes extending through an enclosed internal opening of the gimble ring assembly.

25. The machine of claim 19, further comprising a second user-actuable switch coupled to at least one of the tubes, the second switch being located adjacent the front end of the spine, at least one of the switches causing at least one of the jaws to move toward the other, and the other of the switches limiting the at least one moveable jaw to an intermediate opening position which is less than a fully opening position.

* * * * *